US012338692B2

(12) United States Patent
Strohla

(10) Patent No.: US 12,338,692 B2
(45) Date of Patent: Jun. 24, 2025

(54) SWIVEL SUB WITH BIASING MEMBER

(71) Applicant: Halliburton Energy Services, Inc., Houston, TX (US)

(72) Inventor: Nick Strohla, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 141 days.

(21) Appl. No.: 18/204,307

(22) Filed: May 31, 2023

(65) Prior Publication Data

US 2024/0401420 A1 Dec. 5, 2024

(51) Int. Cl.

| | |
|---|---|
| ***E21B 17/07*** | (2006.01) |
| ***E21B 17/02*** | (2006.01) |
| ***E21B 17/05*** | (2006.01) |
| ***E21B 17/06*** | (2006.01) |

(52) U.S. Cl.

CPC ..... *E21B 17/073* (2013.01); *E21B 17/021* (2013.01); *E21B 17/023* (2013.01); *E21B 17/05* (2013.01); *E21B 17/06* (2013.01)

(58) Field of Classification Search

CPC ..... E21B 17/073; E21B 17/021; E21B 17/05; E21B 34/14; E21B 17/07; E21B 19/00; E21B 34/00; E21B 4/06; E21B 4/10

See application file for complete search history.

(56) References Cited

U.S. PATENT DOCUMENTS

| | | | | |
|---|---|---|---|---|
| 4,688,649 | A | 8/1987 | Buck | |
| 7,777,644 | B2 * | 8/2010 | Madhavan | E21B 17/003 166/380 |
| 8,061,430 | B2 | 11/2011 | Du et al. | |
| 8,511,392 | B2 | 8/2013 | Howlett et al. | |
| 9,683,412 | B2 | 6/2017 | Richards | |
| 9,784,073 | B2 | 10/2017 | Bailey et al. | |
| 12,104,441 | B2 * | 10/2024 | Keane | E21B 47/135 |
| 12,158,043 | B1 * | 12/2024 | Strohla | E21B 17/05 |
| 2004/0216872 | A1 * | 11/2004 | Foster | G01V 11/005 166/380 |
| 2005/0045339 | A1 * | 3/2005 | Hall | E21B 17/003 166/380 |
| 2006/0213670 | A1 | 9/2006 | Bishop et al. | |
| 2009/0078430 | A1 * | 3/2009 | Du | E21B 17/1035 166/207 |

(Continued)

OTHER PUBLICATIONS

International Search Report and Written Opinion for International Patent Application No. PCT/US2023/025767 dated Feb. 21, 2024. PDF file. 9 pages.

*Primary Examiner* — Daniel P Stephenson

(74) *Attorney, Agent, or Firm* — Scott Richardson; C. Tumey Law Group PLLC

(57) ABSTRACT

An apparatus may include a connector sub rigidly securable to a conveyance for running the connector sub along a wellbore and a spool mandrel coupled to a downhole end of the connector sub. The spool mandrel is rotatable with respect to the connector sub. Further, the apparatus may include a control line extending between the connector sub and the spool mandrel. The control line is displaceable to permit rotation of the spool mandrel with respect to the connector sub. Additionally, the apparatus may include at least one biasing member for biasing the spool mandrel to a neutral position with respect to the connector sub.

20 Claims, 10 Drawing Sheets

(56) References Cited

U.S. PATENT DOCUMENTS

| | | | | |
|---|---|---|---|---|
| 2010/0264646 | A1* | 10/2010 | Follini | E21B 17/028 285/119 |
| 2010/0288505 | A1* | 11/2010 | Brown | E21B 17/01 166/346 |
| 2015/0204145 | A1 | 7/2015 | Richards et al. | |
| 2016/0168923 | A1 | 6/2016 | Richards | |
| 2016/0273279 | A1* | 9/2016 | Richards | E21B 17/003 |
| 2017/0138131 | A1* | 5/2017 | Richards | E21B 17/042 |
| 2021/0254432 | A1 | 8/2021 | Honeker et al. | |
| 2024/0401420 | A1* | 12/2024 | Strohla | E21B 17/05 |
| 2024/0401425 | A1* | 12/2024 | Strohla | E21B 23/02 |

* cited by examiner

SWIVEL SUB WITH BIASING MEMBER

BACKGROUND

In the process of completing an oil or gas well, a casing string is run downhole into a wellbore to protect the wellbore from failure (e.g., collapse, erosion) and provide a fluid path for hydrocarbons during production. To access the hydrocarbons for production, a perforating gun system may be deployed into the casing string to form perforations through the casing and wellbore wall such that hydrocarbons may flow into the casing string via the perforation. Downhole completion tools may be run-in-hole once the perforations are formed. For example, a flow regulating system may be disposed proximate the perforations. The flow regulating system may have a screen assembly that controls and limits debris, such as gravel, sand, and other particulate matter, from entering the tubular as the fluid passes through the screen assembly from the perforations. The flow regulating system or other completion tools/assemblies may include completion devices (e.g., inflow control devices, valves, sensors, etc.) that require electricity and/or control signals (e.g., electrical, light, or hydraulic signals) from the surface to operate.

However, the flow regulating system, or other downhole tools, may not extend to the surface as they may be disposed deep in the wellbore proximate the perforations. As such, running a control line from the surface to the downhole tools may be required to operate these downhole tools. Unfortunately, it may be difficult to run the control line to the downhole tool in the correct angular orientation for coupling as the tubular running the control line and/or the downhole tool may rotate or twist from their respective surface orientations while being run-in-hole. Failing to achieve the correct angular orientation between the control line and the downhole tool may require adjustments to the tubular running the control line, which may be time consuming and costly. Further, over rotation of the tubular may strain and damage the control line, which may interrupt production operations. As such, a system is needed that may run the control line in hole to a correct angular orientation with respect to the downhole tool without straining or damaging the control line, which may improve overall production efficiency.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems and methods for connecting a downhole tool with the surface via a control line and, more particularly, example embodiments may include an apparatus (e.g., a swivel sub) for running the control line to the downhole tool. The apparatus includes a connector sub secured to a conveyance (e.g., tubular), as well as a spool mandrel that is rotatably coupled to the connector sub. The control line extends from the surface along the conveyance and across the swivel sub. The control line is displaceable to permit at least some rotation of the spool mandrel with respect to the connector sub without straining and damaging the control line. However, rotation of the spool mandrel with respect to the connector sub is limited between a first angular position and a second angular position by at least one biasing member to prevent over rotation of the spool mandrel, which may strain and damage the control line. However, rotation of the swivel sub between the first angular position and the second angular position may be sufficient rotation to allow the control line to be moved into the correct angular orientation to couple with the downhole tool such that electricity and/or control signals may be transmitted between the surface to the downhole tool.

Figure 1:
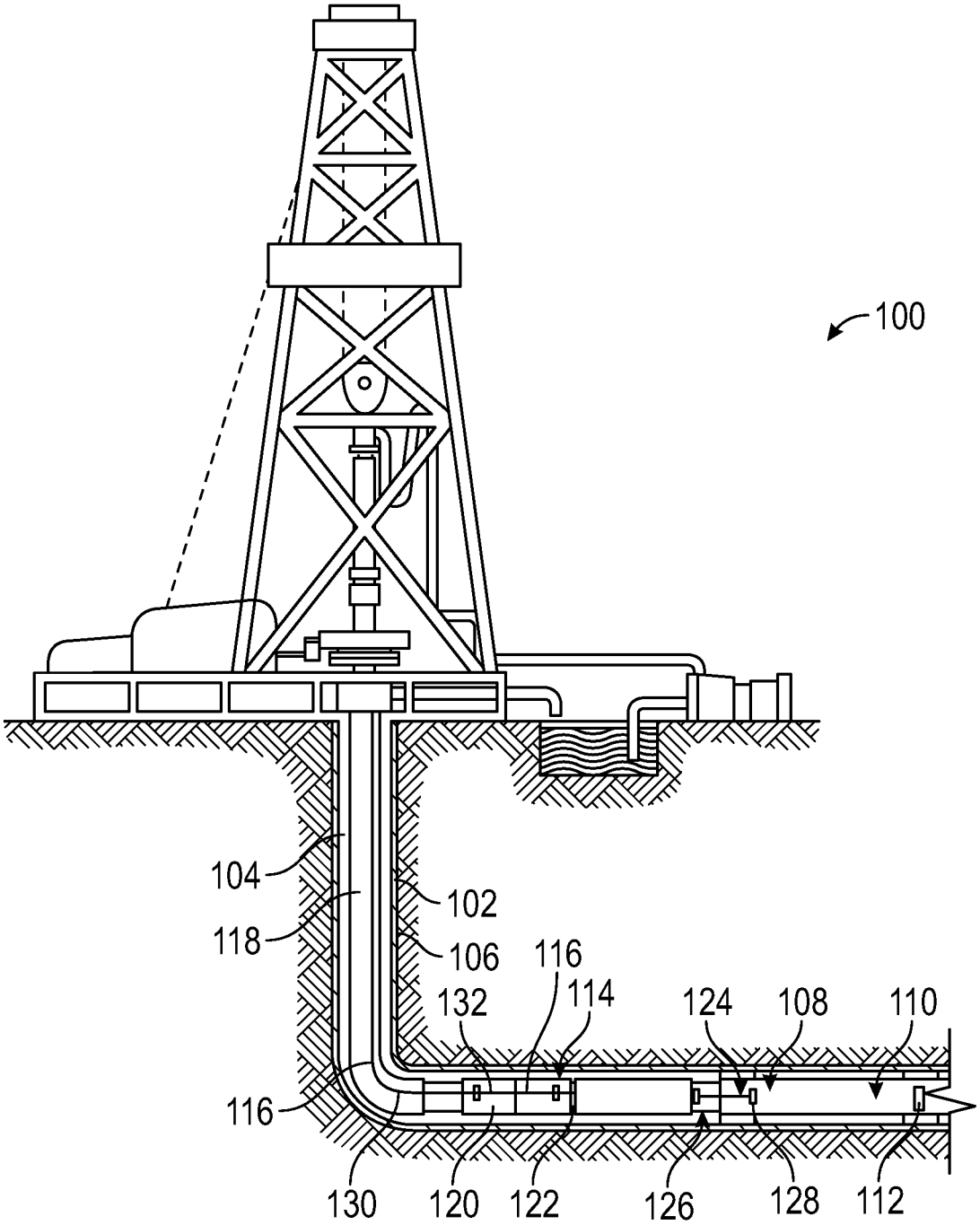
FIG. 1 illustrates an elevation view of a well system, in accordance with some embodiments of the present disclosure.

FIG. 1 illustrates an elevation view of a well system 100, in accordance with some embodiments of the present disclosure. As illustrated, casing 102 may be run downhole into a wellbore 104 to protect the wellbore 104 from failure (e.g., collapse, erosion) and provide a fluid path for hydrocarbons during production. To access the hydrocarbons for production, a perforating gun system may be deployed into the casing 102 to form perforations in the casing 102 and wellbore wall 106 such that hydrocarbons may flow into the casing 102 via the perforation. Downhole completion tools 108 may be run-in-hole once the perforations are formed. For example, a flow regulating system 110 may be disposed proximate the perforations. The flow regulating system 110 may control and limits debris, such as gravel, sand, and other particulate matter, from entering the casing 102 as the fluid passes through the flow regulating system 110 from the perforations. Further, the flow regulating system 110 or other completion tools/assemblies may include completion devices 112 (e.g., inflow control devices, valves, sensors, etc.) that require electricity and/or control signals from the surface to operate. Accordingly, as set forth above, a swivel sub apparatus 114 may be run-in-hole with a control line to couple a control line 116 to the respective downhole tool 108 such that electricity and/or control signals may be transmitted between the surface and the downhole tool 108.

In particular, the swivel sub 114 may be run-in-hole, via a conveyance 118 (e.g., a tubular). The swivel sub 114 includes a connector sub 120 secured to the conveyance 118, as well as a spool mandrel 122 that is rotatably coupled to the connector sub 120. Moreover, the control line 116 extends from the surface along the conveyance 118 and across the swivel sub 114 such that a mating end 124 of the control line 116 is disposed at a downhole end 126 of the swivel sub 114. A portion of the control line 116 secured to the conveyance 118 (e.g., a conveyance control line 130) may be separate from the portion of the control line 116 extending across the swivel sub 114 (e.g., a sub control line 132). For example, the sub control line 132 may be couplable with the conveyance control line 130 extending along the conveyance 118 to put the sub control line 132 of the control line 116 in communication with the surface. Moreover, the control line 116 may be displaceable to prevent strain on the control line 116 from rotation or twisting of the conveyance 118 as the swivel sub 114 is run-in-hole. Further, as set forth above, the control line 116 is also displaceable to permit rotation of the spool mandrel 122 with respect to the connector sub 120 between a first angular position and a second angular position (shown in FIGS. 2A-2B). Indeed, the swivel sub 114 may only be configured to couple to the downhole tool 108 in a particular angular orientation.

The spool mandrel 122 may rotate between the first angular position and the second angular position to align the mating end 124 of the control line 116 with a corresponding connector 128 of the downhole tool 108 as the conveyance 118 drives the swivel sub 114 toward and/or into the downhole tool 108. Contact between the swivel sub 114 and the downhole tool 108 may drive rotation of the swivel sub 114 to the particular angular orientation with respect to the downhole tool 108. The swivel sub 114 and/or the downhole tool 108 may comprise at least one guide feature (not shown) configured to drive rotation of the spool mandrel 122 of the swivel sub 114 in response to contact between the swivel sub 114 and the downhole tool 108. Alternatively, the swivel sub 114 may be configured to self-rotate to the particular angular orientation via any suitable mechanical, electrical, hydraulic, pneumatic, and/or magnetic driving mechanism. Driving the swivel sub 114 into the downhole tool 108 in the particular angular orientation (e.g., with the mating end 124 of the control line 116 aligned with the corresponding connector 128) may couple the control line 116 with the downhole tool 108 to put the downhole tool 108 in electrical communication with the surface such that electricity and/or control signals may be transmitted between the surface to the downhole tool 108.

Moreover, the conveyance 118 may pull the swivel sub 114 in the uphole direction to disengage the swivel sub 114 from the downhole tool 108 in response to an unsuccessful coupling with the downhole tool 108. As set forth in greater detail below, the swivel sub 114 may include a biasing member (shown in FIG. 3) that drives the spool mandrel 122 to rotate toward a neutral angular position of the spool mandrel 122 with respect to the connector sub 120 in response to disengaging the swivel sub 114 from the downhole tool 108. Having the swivel sub 114 in the neutral position may be ideal for coupling with the downhole tool 108 as the spool mandrel 122 may be configured to rotate freely from the neutral position to align the mating end 124 of the control line 116 with the corresponding connector 128 of the downhole tool 108. Accordingly, with the swivel sub 114 in the neutral position, the conveyance 118 may drive the swivel sub 114 into the downhole tool 108 to re-attempt to couple the control line 116 with the downhole tool 108. Having the biasing member bias the swivel sub 114 to the neutral position, in response to disengaging the swivel sub 114 from the downhole tool 108, may permit the swivel sub 114 to re-attempt to couple with the downhole tool 108 from an ideal angular position after each disengagement from the downhole tool 108.

Figure 2A:
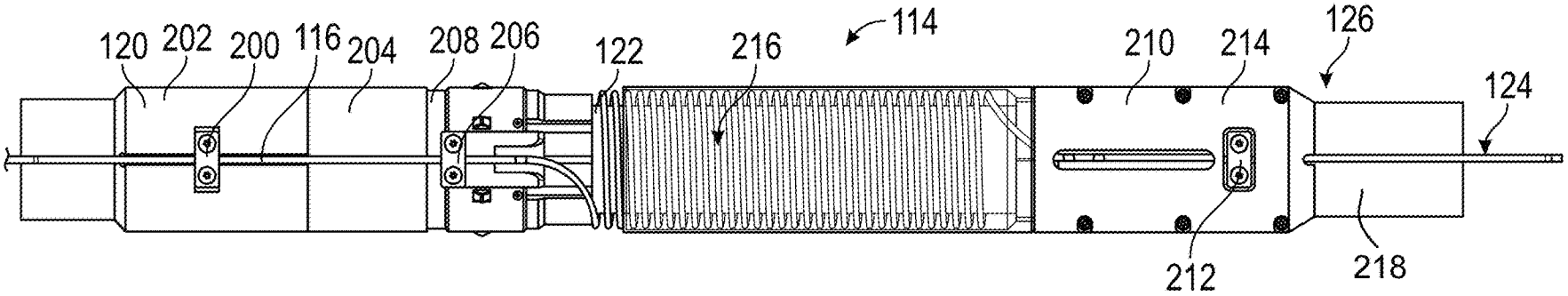
FIGS. 2A-B illustrate respective side views of a swivel sub apparatus, in accordance with some embodiments of the present disclosure.
Figure 2B:
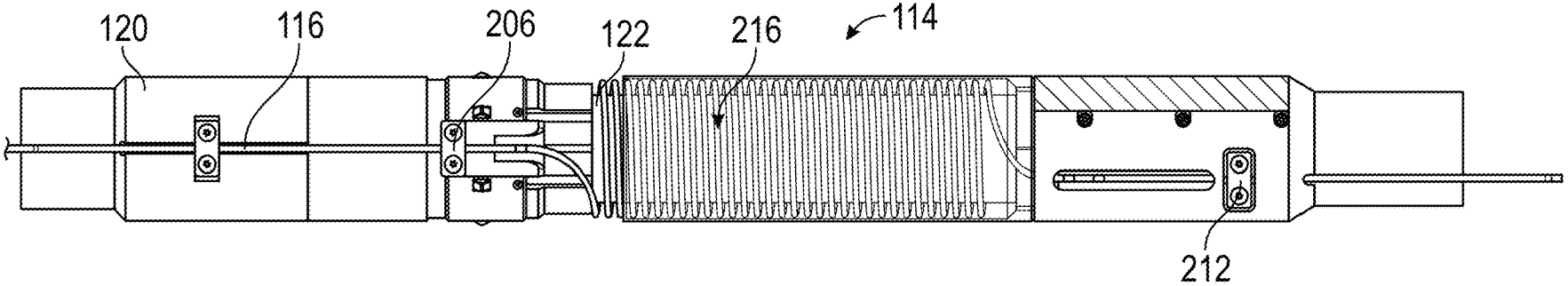

FIGS. 2A-B illustrate respective side views of the swivel sub apparatus 114, in accordance with some embodiments of the present disclosure. Specifically, FIGS. 2A-B illustrate the displaceability of the control line 116 in response to rotation of the spool mandrel 122 with respect to the connector sub 120. FIG. 2A discloses the swivel sub 114 with the spool mandrel 122 in a neutral position with respect to the connector sub 120. As illustrated, the control line 116 may be secured to the connector sub 120 via a first control line housing 200. The first control line housing 200 may be secured to a radially outer connector surface 202 of the connector sub 120. Further, the first control line housing 200 may include a first bore configured to receive the control line 116. That is, the control line 116 may extend through the first bore. As the first control line housing 200 is secured to the connector sub 120, an inner surface of the first bore may restrain radial and circumferential movement of the control line 116 with respect to the connector sub 120. The first control line housing 200 may also be configured to clamp onto the control line 116 to further restrain axial movement of the control line 116 with respect to the first control line housing 200.

Moreover, the control line 116 may be secured to a retainer sub 204 via a second control line housing 206 secured to a radially outer retainer surface 208 of the retainer sub 204. As illustrated, the control line 116 extends from the first control line housing 200 on the connector sub 120 across to the second control line housing 206 on the retainer sub 204. The second control line housing 206 may include a second bore (shown in FIG. 3) configured to receive the control line 116 such that the control line 116 may extend through the second bore. The inner surface of the second bore may restrain radial and circumferential movement of the control line 116 with respect to the connector sub 120. The second control line housing 206 may also be configured to clamp onto the control line 116 to restrain axial movement of the control line 116 with respect to the second control line housing 206. As the retainer sub 204 is rotationally fixed with respect to the connector sub 120, the first control line housing 200 and the second control line housing 206 may maintain a fixed distance during rotation of the spool mandrel, such that restraining axial movement of the control line 116 at the first control line housing 200 and the second control line housing 206 may not strain the control line 116 as the spool mandrel 122 rotates.

Further, the control line 116 may be secured to a clamped mandrel 210 via a third control line housing 212 secured to a radially outer clamped surface 214 of the clamped mandrel 210. Alternatively, the control line housing 212 may be secured to another portion of the swivel sub (e.g., a lower connector mandrel 218) to secure the control line 116 proximate a downhole end 126 of the swivel sub 114. As illustrated, the clamped mandrel 210 may be disposed about a portion of the lower connector mandrel 218. Moreover, the third control line housing 212 may include a third bore configured to receive the control line 116 such that the control line 116 may extend through the third bore. The inner surface of the third bore may restrain radial and circumferential movement of the control line 116 with respect to the clamped mandrel 210 and/or the lower connector mandrel 218. Further, the third control line housing 212 may be configured to clamp onto the control line 116 to restrain axial movement of the control line 116 with respect to the clamped mandrel 210 and/or the lower connector mandrel 218.

As illustrated, the control line 116 extends from the second control line housing 206 on the retainer sub 204 across to the third control line housing 212 on the clamped mandrel 210 and/or the lower connector mandrel 218, which are disposed proximate a downhole end 126 of the swivel sub 114. The clamped mandrel 210 and/or the lower connector mandrel 218 may be rotationally fixed with respect to the spool mandrel 122. As such, rotation of the spool mandrel 122 may drive rotation of the clamped mandrel 210 and/or the lower connector mandrel 218 with respect to the connector sub 120 and the retainer sub 204, which may also rotate the angular position of the control line 116 with respect to the downhole tool 108 (shown in FIG. 1). That is, rotating the spool mandrel 122 may drive rotation of the clamped mandrel 210 and/or the lower connector mandrel 218 to rotate the mating end 124 of the control line 116 for aligning and mating with the corresponding connector 128 (shown in FIG. 1) of the downhole tool 108. Additionally, restraining axial movement of the control line 116 at the clamped mandrel 210 and/or the lower connector mandrel 218 may hold the mating end 124 of the control line 116 in a fixed angular position on the clamped mandrel 210 and/or the lower connector mandrel 218 at the downhole end 126 of the swivel sub 114 such that rotation of the spool mandrel 122 also rotates the angular position of the control line 116 with respect to the downhole tool 108.

Moreover, as the clamped mandrel 210 and/or the lower connector mandrel 218 rotates with respect to the connector sub 120 and the retainer sub 204 in response to rotation of the spool mandrel 122, the distance between the second control line housing 206 and the third control line housing 212 may increase. The control line 116 extends from the second control line housing 206 to the third control line housing 212. As such, the control line 116 may be displaced (e.g., stretched, uncoiled, recoiled, etc.) in response to rotation of the spool mandrel 122. To reduce strain on the control line 116 from such displacement, the control line 116 may comprise a coiled portion 216 between the second control line housing 206 and the third control line housing 212. Specifically, the control line 116 may be coiled about the spool mandrel 122 (e.g., forming the coiled portion 216) between the second control line housing 206 and the third control line housing 212. Having the coiled portion 216 may increase the length of the control line 116 between the second control line housing 206 and the third control line housing 212. Increasing the length of the control line 116 may reduce strain on the control line 116 by spreading the deformation of the control line 116, from the displacement (e.g., stretching), across a greater length. Alternatively, or additionally, the control line 116 may be uncoiled in response to rotation of the spool mandrel 122 to accommodate the variable distance between the second control line housing 206 and the third control line housing 212 and reduce strain on the control line 116. Indeed, the coiled portion 216 of the control line 116 may be advantageous for reducing strain on the control line 116 as the spool mandrel 122 rotates, which varies the distance between the second control line housing 206 and the third control line housing 212.

Further, the swivel sub may include at least one biasing member 220, which may limit strain on the control line 116. The biasing member 220 may be attached to the connector sub 120 and the spool mandrel 122 to bias the spool mandrel 122 to a neutral position (e.g., a first angular position of the spool mandrel 122) with respect to the connector sub 120. In the neutral position, the control line 116 may be unstrained (e.g., unstretched) or lightly strained. However, as the spool mandrel 122 rotates and the distance between the second control line housing 206 and the third control line housing 212 increases, the control line 116 may be increasingly strained. Generally, a material initially undergoes elastic deformation as it is strained. A material that is elastically deformed may return to its pre-strained form when released. However, further strain may cause the material to experience plastic deformation, which may permanently deform the material. To avoid damaging the control line 116 (e.g., plastic deformation), the biasing member 220 may effectively limit rotation of the spool mandrel 122 at a second angular position, which may be angularly offset from the first angular position by three hundred and sixty degrees to seven hundred and twenty degrees.

The biasing force on the spool mandrel 122 from the biasing member 220 may increase in response to rotation of the spool mandrel 122 away from the neutral position, such that the biasing force may be sufficiently large to effectively limit rotation driven by expected downhole forces at the second angular position of the spool mandrel 122. The biasing force may be proportional to the amount (e.g., angle) that the spool mandrel 122 is rotated. Further, the expected downhole forces may include forces driving rotation of the spool mandrel 122 in response to contact between the swivel sub 114 and the downhole tool 108 for aligning the control line 116 with the corresponding connector 128 of the downhole tool 108 (shown in FIG. 1). As such, the biasing member 220 may permit rotation between the first angular position and the second angular position for aligning the control line 116 with the downhole tool 108, but the biasing force on the spool mandrel 122 at the second angular position may be sufficiently high to effectively limit further rotation of the spool mandrel 122.

As set forth in further detail below, the at least one biasing member 220 may comprise a return spring (shown in FIG. 4) secured to the connector sub 120 and the spool mandrel 122. The return spring may comprise a torsion spring, a compression spring, a tension spring, or some combination thereof. Further, the return spring may include any suitable elastic material for storing mechanical energy such that rotation of the spool mandrel 122 with respect to the connector sub 120 may generate a biasing force (e.g., spring force) as the return spring is elastically strained. The biasing force may drive rotation of the spool mandrel 122 toward the neutral position of the spool mandrel 122 with respect to the connector sub 120.

Alternatively, or additionally, the at least one biasing member 220 may comprise the coiled portion 216 of the control line 116. That is, at least a portion of the control line 116 may include an elastic material for storing mechanical energy such that straining the coiled portion 216 may generate the biasing force (e.g., spring force) to drive rotation of the spool mandrel 122 toward the neutral position of the spool mandrel 122 with respect to the connector sub 120. Further, rotation of the spool mandrel 122 in a first direction (e.g., a clockwise direction) may place the control line 116 in tension as the distance between the second control line housing 206 and the third control line housing 212 increases, which may uncoil and/or stretch (e.g., strain) the control line 116. As set forth above, straining the control line 116 may generate the spring force to drive the spool mandrel 122 toward the neutral position. Additionally, rotation of the spool mandrel 122 in a second direction (e.g., a counterclockwise direction) may place the control line 116 in compression due to the orientation of the coiled portion 216 of the control line 116 with respect to the direction of rotation. However, compressing the control line 116 may also generate the spring force to drive the spool mandrel 122 toward the neutral position. Moreover, the at least one biasing member 220 may comprise both the coiled portion 216 of the control line 116 as well as the return spring (shown in FIG. 4). That is, the coiled portion 216 of the control line 116 and the return spring may both generate respective biasing forces (e.g., spring forces) to drive the spool mandrel 122 toward the neutral position in response to rotation of the spool mandrel 122 away from the neutral position.

FIG. 2B discloses the swivel sub apparatus 114 with the spool mandrel 122 in a rotated position with respect to the connector sub 120. In particular, the spool mandrel 122 is rotated counterclockwise with respect to the connector sub 120. Such rotation increases the distance between the second control line housing 206 and the third control line housing 212. As set forth above, the control line 116 is axially fixed at the second control line housing 206 and the third control line housing 212. As such, the coiled portion 216 of the control line 116 may be displaced (e.g., stretch, uncoil, etc.) to accommodate the increased distance between the second control line housing 206 and the third control line housing 212.

Moreover, as set forth above, the control line 116 and/or the return spring may bias the spool mandrel 122 toward the neutral position with the spool mandrel 122 rotated from the neutral position. Rotating the spool mandrel 122 back to the neutral position may reduce the distance between the second control line housing 206 and the third control line housing 212. As such, the coiled portion 216 of the control line 116 may recoil and/or compress back to a neutral state (e.g., initial length, orientation, etc.) between the second control line housing 206 and the third control line housing 212. Indeed, the biasing member 220 may effectively limit rotation of the spool mandrel 122 at the second angular position to prevent permanent strain and damage to the control line 116 such that the control line 116 may recoil and/or compress back to a neutral state.

Figure 3:
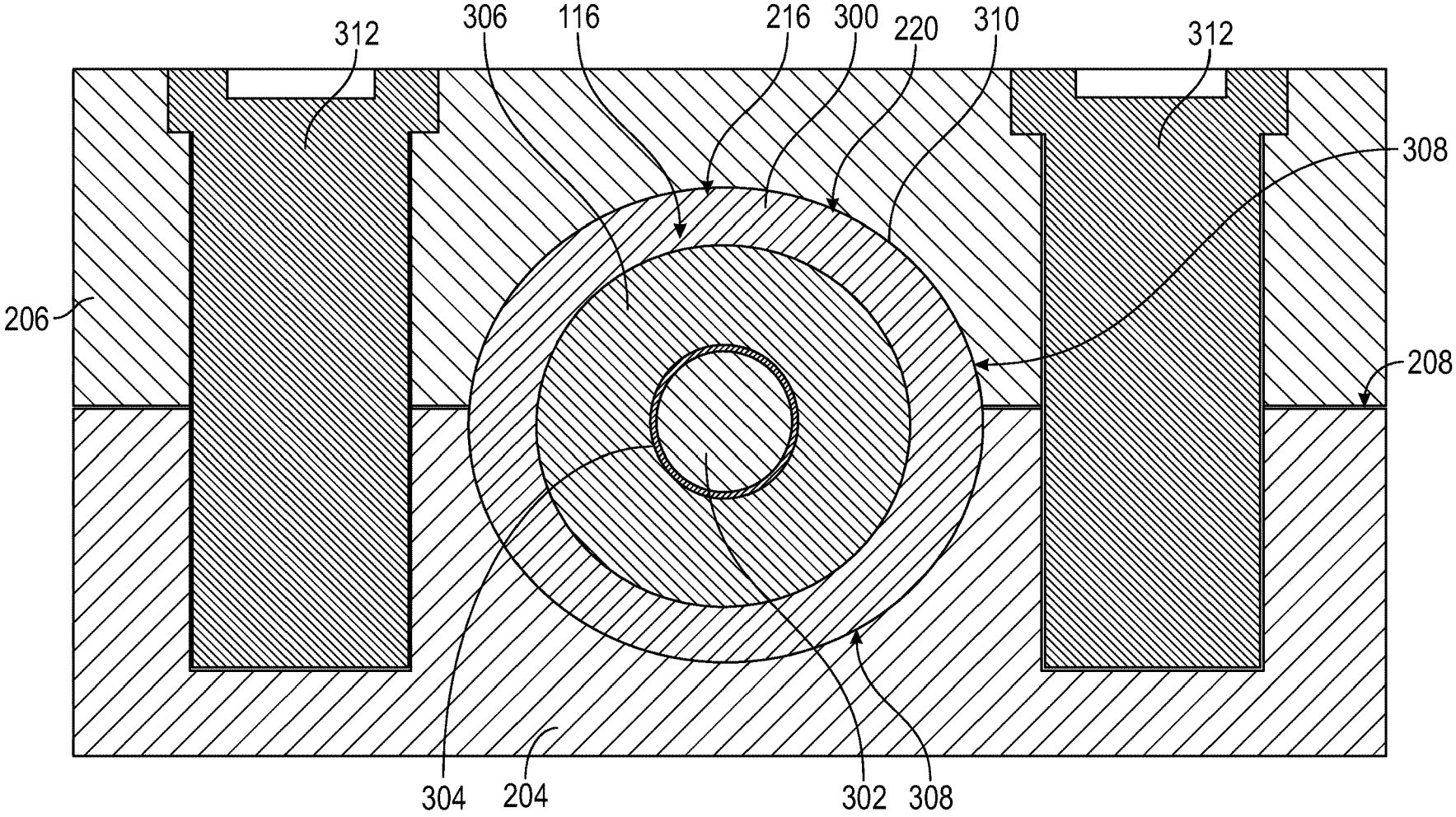
FIG. 3 illustrates a cross-sectional view of a control line of a swivel sub apparatus secured in a control line housing, in accordance with some embodiments of the present disclosure.

FIG. 3 illustrates a cross-sectional view of the control line of a swivel sub apparatus secured in a control line housing (e.g., the second control line housing), in accordance with some embodiments of the present disclosure. As set forth above, the at least one biasing member 220 may comprise the coiled portion 216 of the control line 116. That is, at least a portion of the control line 116 may include an elastic material for storing mechanical energy such that straining the coiled portion 216 may generate the biasing force (e.g., spring force) to drive rotation of the spool mandrel 122 toward the neutral position of the spool mandrel 122 with respect to the connector sub 120 (shown in FIG. 2). As illustrated, the control line 116 may comprise an outer jacket 300 disposed about a conductor 302 (e.g., wire), a strand shielding 304, and/or an insulation sleeve 306. The outer jacket 300 may include the elastic material suitable for storing mechanical energy. As such, the outer jacket 300 of the control line 116 may generate the biasing force (e.g. spring force) in response to rotation of the spool mandrel 122 putting the control line 116 in tension and/or compression and strains the control line 116. As set forth above, the biasing force is configured to drive rotation of the spool mandrel 122 to the neutral position of the spool mandrel 122 with respect to the connector sub. Alternatively, or additionally, another portion of the control line 116 may comprise an elastic material suitable for storing mechanical energy. For example, the insulation sleeve 306 and/or the conductor 302 of the control line 116 may include an elastic material for storing mechanical energy. Further, the control line 116 may alternatively be configured to send hydraulic communication or light communication (e.g., fiber optics). The outer jacket 300 around such control lines 116 may comprise the elastic material suitable for storing mechanical energy.

Moreover, as set forth above, the control line 116 may be secured to a retainer sub 204 via the second control line housing 206, which is secured to the radially outer retainer surface 208 of the retainer sub 204. The second control line housing 206 may include a second bore 308 configured to receive the control line 116 such that the control line 116 may extend through the second bore 308. Additionally, or alternatively, a portion of the second bore 308 may extend through a portion of the retainer sub 204. The inner surface 310 of the second bore 308 may restrain radial movement and/or circumferential movement of the control line 116 with respect to the connector sub 120. The second control line housing 206 may also be configured to clamp onto the control line 116 to restrain axial movement of the control line 116 with respect to the second control line housing 206. For example, the second control line housing 206 may comprise at least one fastener 312 (e.g., a bolt) configured to thread into the second control line housing 206 and the retainer sub 204. Tightening the fastener 312 may increase the clamping force of the second control line housing 206 onto the control line 116 to restrain axial movement of the control line 116. Alternatively, the fastener 312 may be threaded less tightly to reduce the clamping force such that the control line 116 may move axially through the second bore 308.

Figure 4:
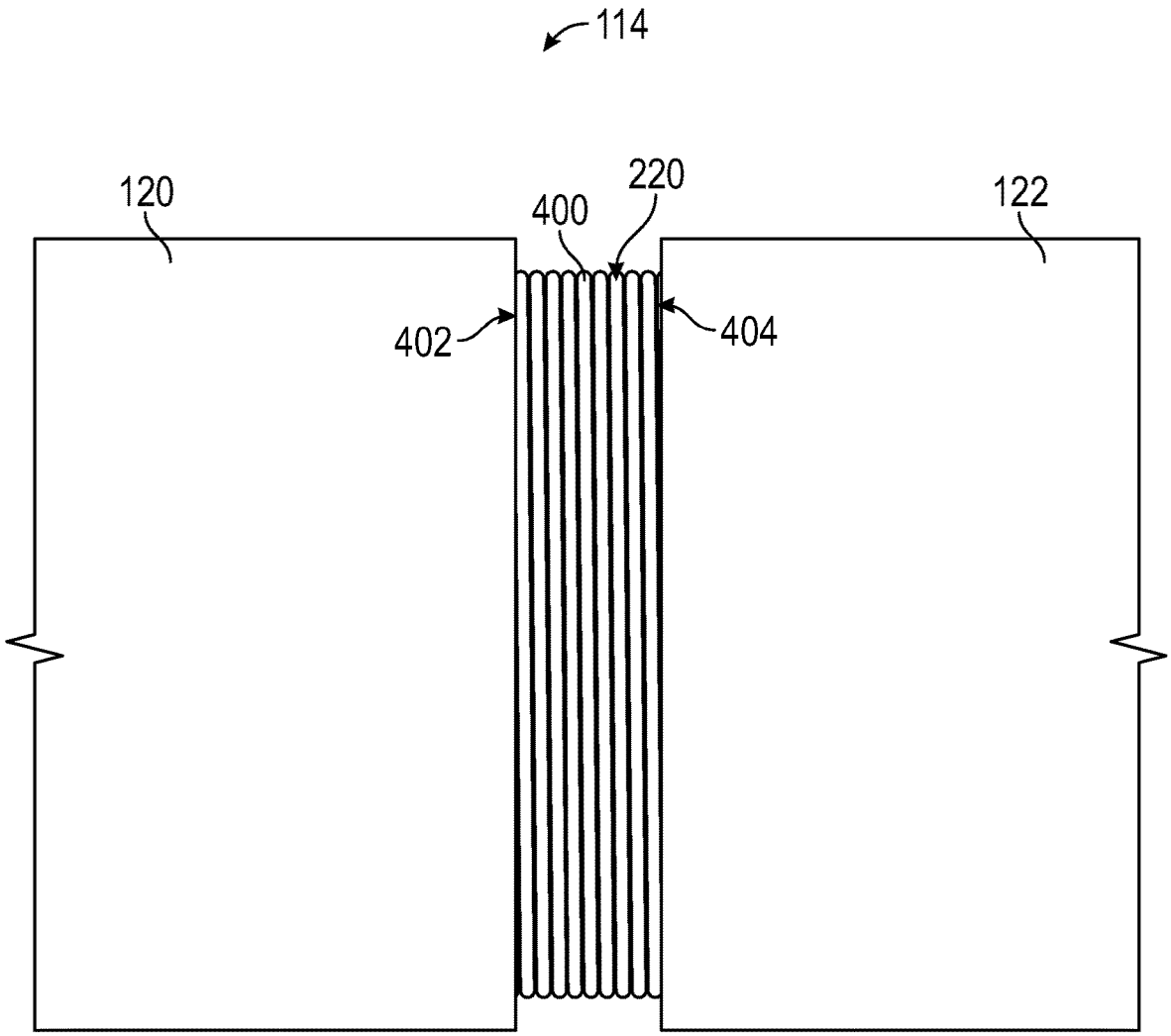
FIG. 4 illustrates a side view of a swivel sub apparatus having a return spring, in accordance with some embodiments of the present disclosure.

FIG. 4 illustrates a side view of a swivel sub apparatus 114 having a return spring 400, in accordance with some embodiments of the present disclosure. As set forth above, the at least one biasing member 220 may comprise the return spring 400 secured to the connector sub 120 and the spool mandrel 122. As illustrated, the return spring 400 may be disposed between the connector sub 120 and the spool mandrel 122 with a first end 402 of the return spring 400 secured to the connector sub 120 and a second end 404 of the return spring 400 secured to the spool mandrel 122. However, the return spring 400 may be disposed in any suitable position for biasing the spool mandrel 122 with respect to the connector sub 120. For example, the return spring 400 may be disposed between the retainer sub 204 and the spool mandrel 122 with the first end 402 of the return spring 400 secured to the retainer sub 204 and the second end 404 of the return spring 400 secured to the spool mandrel 122. As the retainer sub 204 may be rigidly secured to the connector sub 120, having the return spring 400 secured to the retainer sub 204 and the spool mandrel 122 may bias the spool mandrel 122 with respect to the connector sub 120.

Moreover, as set forth above, the return spring 400 may comprise a torsion spring, a compression spring, a tension spring, or some combination thereof. Further, the return spring 400 may include any suitable elastic material for storing mechanical energy such that rotation of the spool mandrel 122 with respect to the connector sub 120 may generate the biasing force (e.g., spring force) as the return spring 400 is elastically strained. The biasing force on the spool mandrel 122 from the return spring 400 may increase in response to rotation of the spool mandrel 122 away from the neutral position. Indeed, the biasing force may be proportional to the amount (e.g., angle) that the spool mandrel 122 is rotated. As such, the biasing force may be sufficiently large to effectively limit rotation of the spool mandrel 122 at the second angular position. Additionally, the biasing force may drive rotation of the spool mandrel 122 toward the neutral position of the spool mandrel 122 with respect to the connector sub 120.

Figure 5:
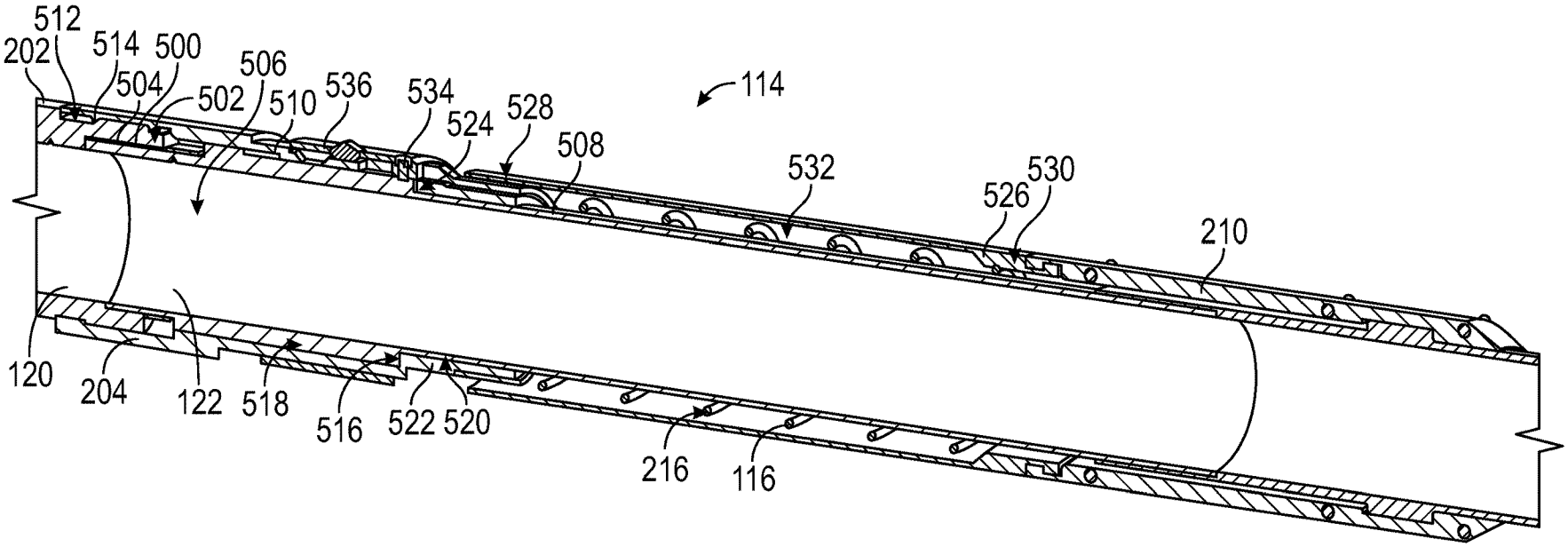
FIG. 5 illustrates a cross-sectional view of a swivel sub apparatus, in accordance with some embodiments of the present disclosure.

FIG. 5 illustrates a cross-sectional view of the swivel sub apparatus 114, in accordance with some embodiments of the present disclosure. As set forth above, the spool mandrel 122 may be configured to rotate with respect to the connector sub to align the mating end of the control line with a corresponding connector of the downhole tool. Accordingly, spool mandrel 122 may be rotatably coupled to the connector sub 120. As illustrated, the spool mandrel 122 may be at least partially disposed within the connector sub 120. In particular, the connector sub 120 and the spool mandrel 122 each comprise a substantially tubular shape. A radially inner connector surface 500 of a downhole end 502 of the connector sub 120 may have a greater diameter than a radially outer mandrel surface 504 of an uphole end 506 of the spool mandrel 122, such that the uphole end 506 of the spool mandrel 122 may be disposed in the downhole end 502 of the connector sub 120. Having the uphole end 506 of the spool mandrel 122 disposed in the downhole end 502 of the connector sub 120 may restrain radial movement of the spool mandrel 122 with respect to the connector sub 120. However, the spool mandrel 122 may be rotatable with respect to the connector sub 120 between the first angular position and the second angular position.

Moreover, the swivel sub 114 may include a retainer sub 204 for restraining axial movement of the spool mandrel 122 with respect to the connector sub 120. As illustrated, the retainer sub 204 may be disposed radially exterior to the connector sub 120 and the spool mandrel 122. The connector sub 120 and the spool mandrel 122 may each include slots and or shoulders formed in their respective radially outer surfaces (e.g., radially outer connector surface 202 and radially outer spool surface 508). The retainer sub 204 may include corresponding features formed in a radially inner retainer surface 510 of the retainer sub 204 for interfacing with the slots and/or shoulders formed in connector sub 120 and spool mandrel 122. Such interfaces may restrain axial movement of the spool mandrel 122 with respect to the connector sub 120.

For example, as illustrated, the connector sub 120 may include an outer connector slot 512 formed in the radially outer connector surface 202 of the connector sub 120. The outer connector slot 512 may at least partially extend about the circumference of the connector sub 120. The retainer sub 204 may include a corresponding retainer protrusion 514 extending radially inward from the radially inner retainer surface 510 of the retainer sub 204. The retainer protrusion 514 may at least partially extend about the circumference of the radially inner retainer surface 510. The retainer protrusion 514 may be disposed within the outer connector slot 512 and contact between the retainer protrusion 514 and the outer connector slot 512 may restrain axial movement of the connector sub 120 with respect to the retainer sub 204. Further, the swivel sub 114 may include additional fasteners and/or interfaces to rigidly secure or affix the connector sub 120 to the retainer sub 204 (e.g., restrain axial, radial, and rotational movement between the connector sub 120 and the retainer sub 204).

Moreover, the spool mandrel 122 may include a spool shoulder 516 formed at a transition between a protruding portion 518 of the spool mandrel 122 and a base portion 520 of the spool mandrel 122. The protruding portion 518 may have a larger diameter than the base portion 520 such that the spool shoulder 516 is formed at the transition. As illustrated, the retainer sub 204 may include a radially inner lip 522 formed in the radially inner retainer surface 510 of the retainer sub 204. An uphole end 524 of the radially inner lip 522 may interface with the spool shoulder 516 to restrain downhole movement of the spool mandrel 122 with respect to the retainer sub 204 and the connector sub 120. Additionally, uphole movement of the spool mandrel 122 with respect to the retainer sub 204 and the connector sub 120 may be restrained by an interface between the uphole end 506 of the spool mandrel 122 and the downhole end 502 of the connector sub 120. As such, axial movement between the spool mandrel 122 and the connector sub 120 may be restrained.

Additionally, a shroud 526 may be disposed about the coiled portion 216 of the control line 116. An uphole end 528 of the shroud 526 may be secured to the retainer sub 204, and a downhole end 530 of the shroud 526 may be secured to the clamped mandrel 210. Further, the shroud 526 may be radially offset from the spool mandrel 122 such that a control line cavity 532 is formed between the spool mandrel 122 and the shroud 526 for housing the coiled portion 216 of the control line 116. The shroud 526 may shield the coiled portion 216 of the control line 116 from the downhole environment.

Moreover, as set forth above, the spool mandrel 122 may freely rotate with respect to the connector sub 120 between the first angular position and the second angular position. However, as the swivel sub 114 is run-in-hole, rotation of the spool mandrel 122 with respect to the connector sub 120 may be undesirable. As such, the swivel sub 114 may include a shear member 534 (e.g., shear pin or other suitable fastener) configured to restrain rotation of the spool mandrel 122 with respect to the connector sub 120. The shear member 534 may initially hold the spool mandrel 122 in a neutral position between the first and second angular position. However, once the swivel sub 114 is positioned proximate the downhole tool 108, rotation of the spool mandrel 122 may be needed to re-orient the control line 116 with respect to the corresponding connector 128 of the downhole tool 108. As such, the swivel sub 114 may include a shear mechanism 536 to shear the shear member 534, which releases the spool mandrel 122 to rotate with respect to the connector sub 120. As set forth in greater detail below, the shear mechanism 536 may be configured to actuate in response to the shear mechanism 536 contacting the downhole tool 108 (shown in FIG. 1). Such contact may apply a threshold force needed for shearing the shear member 534.

Figure 6A:
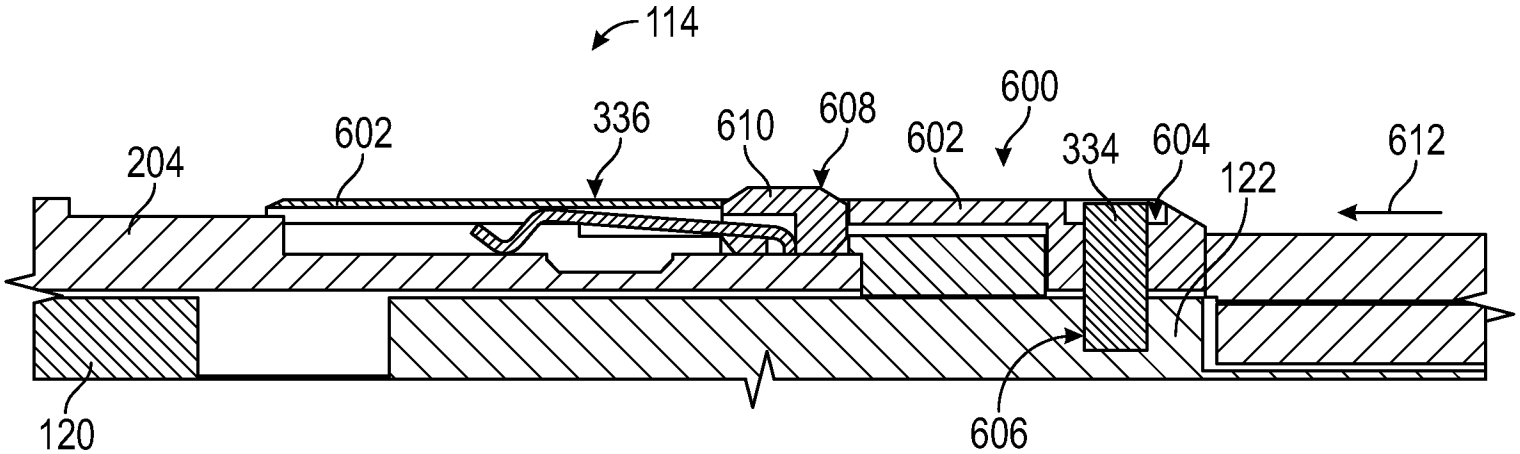
FIGS. 6A-B illustrate respective cross-sectional views of a sliding pin shear mechanism, in accordance with some embodiments of the present disclosure.
Figure 6B:
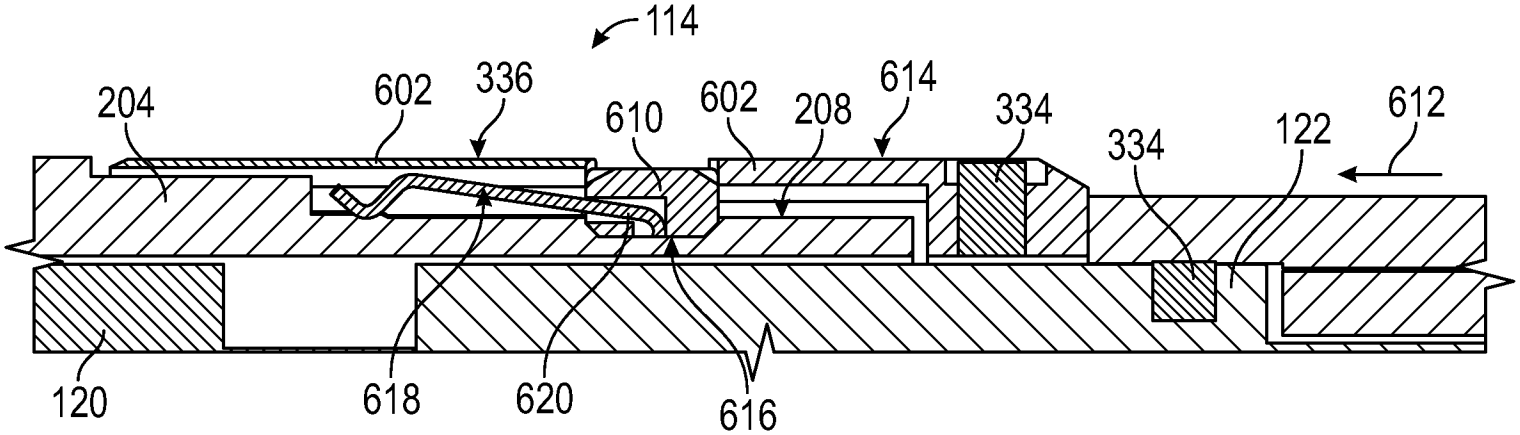

FIGS. 6A-B illustrate respective cross-sectional views of a sliding pin shear mechanism, in accordance with some embodiments of the present disclosure. In particular, FIG. 6A discloses the shear mechanism 536 (e.g., a sliding pin shear mechanism) and the shear member 534 (e.g., shear pin) holding the spool mandrel 122 in a run-in position (e.g., a position of the spool mandrel 122 while being run-in-hole). As set forth above, the retainer sub 204 may be rigidly secured to the connector sub 120 such that the retainer sub 204 is axially and rotationally fixed with respect to the connector sub 120. Further, the shear mechanism 536 may be secured to the retainer sub 204 in a first axial position 600 such that rotational movement between the shear mechanism 536 and the retainer sub 204 is restrained. However, as set forth in detail below, the shear mechanism 536 may move axially with respect to the retainer sub 204.

Moreover, the shear mechanism 536 may comprise a sleeve 602 having a shear member slot 604. As illustrated, the shear member 534 may be disposed in the shear member slot 604 to hold the spool mandrel 122 in the run-in position as the swivel sub 114 is run-in-hole. That is, the shear member 534 may extend through the shear member slot 604 and into a spool slot 606 formed in the spool mandrel 122. As such, the shear member 534 may restrain rotational movement and/or axial movement between the shear mechanism 536 and the spool mandrel 122. Further, as the shear mechanism 536 is secured to the retainer sub 204 and the retainer sub 204 is secured to the connector sub 120, restraining rotational movement between the shear mechanism 536 and the spool mandrel 122 may restrain rotational movement between the spool mandrel 122 and the connector sub 120.

The shear mechanism 536 may further comprise an interface feature 608 configured to engage (e.g., contact) the downhole tool 108 as the conveyance 118 drives the swivel sub 114 into the downhole tool 108 (shown in FIG. 1). The interface feature 608 may include a protrusion (e.g., retractable interface pin 610) housed by the sleeve 602. Further, retractable interface pin 610 may be extendable and retractable with respect to the sleeve 602. As illustrated, the retractable interface pin 610 may be disposed in a radially extended position as the swivel sub 114 is run-in-hole, such that the retractable interface pin 610 may engage the downhole tool 108. Contact between the interface pin 610 and the downhole tool 108 may generate a force on the retractable interface pin 610 to drive the retractable interface pin 610 and the sleeve 602 in the axially uphole direction 612 with respect to the spool mandrel 122. However, as set forth above, the shear member 534 may restrain axial movement of the sleeve 602 with respect to the spool mandrel 122. That is, the shear member 534 may restrain axial movement of the sleeve 602 until the force being applied to the retractable interface pin 610 exceeds a threshold force. At or above the threshold force, the sleeve 602 may shear the shear member 534 and slide in the axially uphole direction 612. The swivel sub 114 engaging the downhole tool 108 may apply a force to the sleeve 602, at or above the threshold force, such that the shear mechanism 536 may shear the shear member 534 in response to the swivel sub apparatus 114 engaging a downhole tool 108.

FIG. 6B discloses the shear mechanism 536 disposed in a locked position 614 (e.g., a second axial position) after sliding in the axially uphole direction 612 in response to the shear member 534 being sheared. As set forth above, the interface feature (e.g., retractable interface pin 610) is disposed in the radially extended position as the swivel sub 114 is run-in-hole due at least in part to the radially outer retainer surface 208 of the retainer sub 204 biasing the retractable interface pin 610 toward the radially extended position. However, in the locked position 614, the retractable interface pin 610 may be disposed in a retracted position with respect to the sleeve 602. As illustrated, the retractable interface pin 610 may be axially aligned with a corresponding interface feature slot 616 formed in the retainer sub 204 such that the retractable interface pin 610 may retract into the interface feature slot 616 as the shear mechanism 536 slides to the locked position 614. In a retracted position, the retractable interface pin 610 may cease to contact the downhole tool 108 such that the shear mechanism 536 may avoid interfering with rotation of the spool mandrel 122 with respect to the downhole tool 108 as the mating end 124 of the control line 116 is re-oriented to mate with the corresponding connector 128 of the downhole tool 108 (shown in FIG. 1).

Moreover, the shear mechanism 536 may further include a locking feature 618 configured to secure the shear mechanism 536 in the locked position 614. As illustrated, the locking feature 618 may include a biasing arm 620 connected to the retractable interface pin 610. The biasing arm 620 may be configured to bias the retractable interface pin 610 radially inward to hold the retractable interface pin 610 disposed in the interface feature slot 616 in the locked position 614. Further, contact between axial surfaces of the retractable interface pin 610 and the interface feature slot 616 may restrain axial movement of the retractable interface pin 610, which also restrains axial movement of the sleeve 602 to hold the shear mechanism 536 in the locked position 614.

Figure 7A:
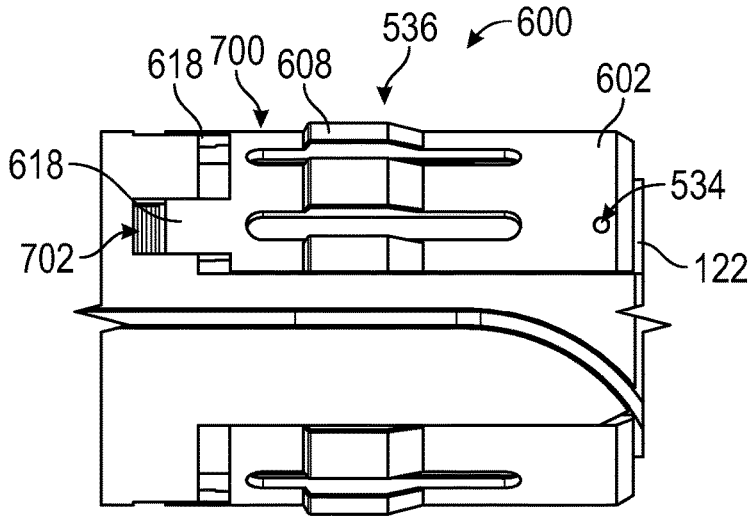
FIGS. 7A-C illustrate respective perspective and cross-sectional views of a double ended collet shear mechanism, in accordance with some embodiments of the present disclosure.
Figure 7B:
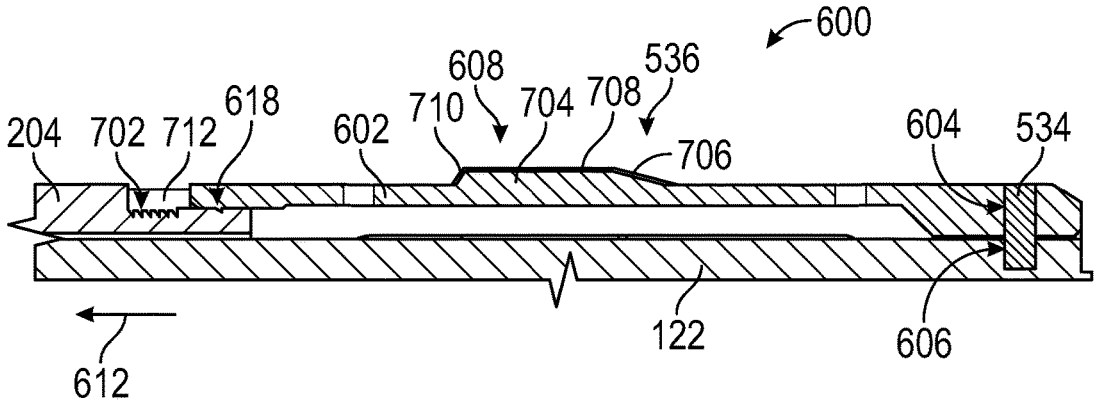
Figure 7C:
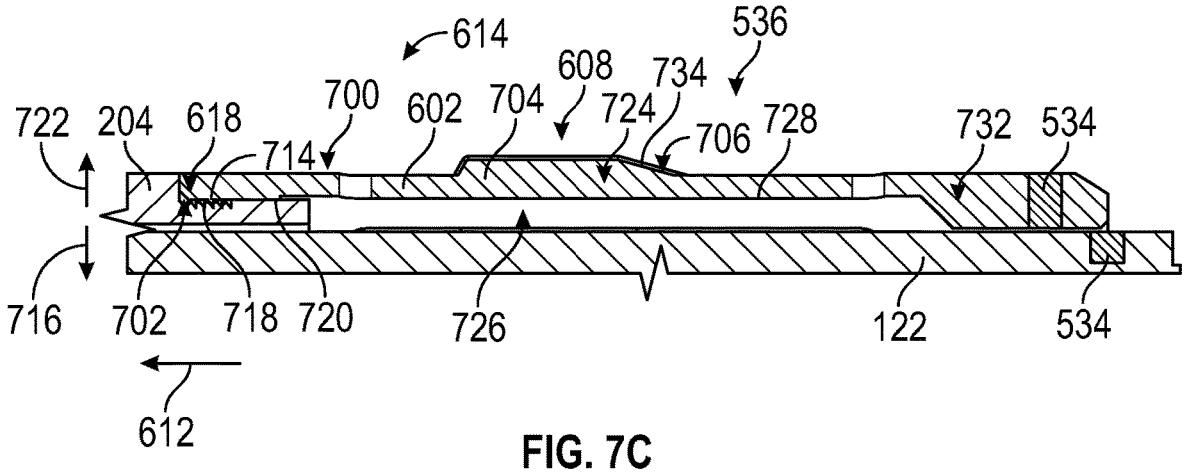

FIGS. 7A-C illustrate respective perspective and cross-sectional views of a double ended collet shear mechanism, in accordance with some embodiments of the present disclosure. In particular, FIG. 7A illustrates a perspective view of the shear mechanism 536 (e.g., the double ended collet shear mechanism) and the shear member 534 (e.g., the shear pin) holding the spool mandrel 122 in a run-in position (e.g., the first axial position 600). The shear mechanism 536 may include the sleeve 602 with at least one interface feature 608 extending radially outward from the sleeve 602. As set forth above, the at least one interface feature 608 may engage the downhole tool 108 as the swivel sub 114 is run-in-hole (shown in FIG. 1). The at least one interface feature 608 may include a plurality of interface features 608 disposed about the sleeve 602. Moreover, the sleeve 602 may extend circumferentially about the spool mandrel 122. Further, the shear mechanism 536 may include at least one locking feature 618 extending axially from a first end 700 (e.g., uphole end) of the sleeve 602. The at least one locking feature 618 may include a plurality of locking feature 618 extending from the first end 700 of the sleeve 602. The locking features 618 may be evenly spaced about the circumference of the sleeve 602. For example, the locking features 618 may be spaced thirty degrees to 90 degrees apart. Alternatively, the locking features 618 may be unevenly spaced about the circumference of the sleeve 602. Moreover, the at least one locking feature 618 may interface with a corresponding retainer slot 702 in the retainer sub 204 to restrain rotational movement of the shear mechanism 536 with respect to the retainer sub 204 in at least the first axial position 600.

FIG. 7B illustrates a cross-sectional view of the shear mechanism 536 and the shear member 534 (e.g., shear pin) holding the spool mandrel 122 in a run-in position (e.g., the first axial position 600). As set forth above, the retainer sub 204 may be rigidly secured to the connector sub 120 such that the retainer sub 204 is axially and rotationally fixed with respect to the connector sub 120. Further, as set forth in detail below, the shear mechanism 536 may be rotationally fixed with respect to the retainer sub 204 in the first axial position 600. Moreover, the sleeve 602 of the shear mechanism 536 may have a shear member slot 604. As illustrated, the shear member 534 may be disposed in the shear member slot 604 to hold the spool mandrel 122 in the run-in position as the swivel sub 114 is run-in-hole. That is, the shear member 534 may extend through the shear member slot 604 and into a spool slot 606 formed in the spool mandrel 122. As such, the shear member 534 may restrain rotational movement, as well as axial movement, between the shear mechanism 536 and the spool mandrel 122, which may restrain rotational movement between the spool mandrel 122 and the connector sub 120 (shown in FIG. 2).

The shear mechanism 536 further includes the interface feature 608 configured to engage (e.g., contact) the downhole tool 108 as the conveyance 118 drives the swivel sub 114 into the downhole tool 108 (shown in FIG. 1). The interface feature 608 may include a protrusion 704 extending radially outward from the sleeve 602 to a position for engaging the downhole tool 108 as the swivel sub 114 is run-in-hole. The protrusion 704 may include a leading face 706 configured to engage the downhole tool 108. The protrusion 704 may also include a radially outer face 708 and a trailing face 710. Contact between the leading face 706 of the protrusion 704 and the downhole tool 108 may generate a force on the protrusion 704 to drive the protrusion 704 and the sleeve 602 in the axially uphole direction 612 with respect to the spool mandrel 122. However, as set forth above, the shear member 534 may restrain axial movement of the sleeve 602 with respect to the spool mandrel 122. That is, the shear member 534 may restrain axial movement of the sleeve 602 until the force being applied to the sleeve 602 exceeds a threshold force. At or above the threshold force, the sleeve 602 may shear the shear member 534 and slide in the axially uphole direction 612. The swivel sub 114 engaging the downhole tool 108 may apply a force to the sleeve 602, at or above the threshold force, such that the shear mechanism 536 may shear the shear member 534 in response to the swivel sub apparatus 114 engaging a downhole tool 108.

Moreover, the shear mechanism 536 may include at least one locking feature 618 extending axially from the first end 700 (e.g., uphole end) of the sleeve 602. Further, the retainer sub 204 may include at least one corresponding retainer slot 702. In the first axial position 600, the at least one locking feature 618 may be at least partially disposed in the retainer slot 702. Contact between the at least one locking feature 618 and a circumferential side surface 712 of the retainer slot 702 may restrain rotational movement of the shear mechanism 536 with respect to the retainer sub 204 in the first axial position 600.

FIG. 7C illustrates a cross-sectional view of the shear mechanism 536 disposed in a locked position 614 (e.g., a second axial position) after sliding in the axially uphole direction 612 in response to the shear member 534 being sheared. As set forth above, the shear mechanism 536 may include the at least one locking feature 618 extending axially from the first end 700 (e.g., uphole end) of the sleeve 602. The locking feature 618 may comprise at least one tooth 714, or other suitable protrusion, extending from the locking feature 618. In particular, the at least one tooth 714 may extend in a radially inward direction 716 from the locking feature 618 with respect to the spool mandrel 122. Alternatively, the at least one tooth 714 may extend circumferentially outward from the locking feature 618. Further, the retainer sub 204 may include the at least one corresponding retainer slot 702. The at least one retainer slot 702 may include at least one tooth slot 718 formed in a radially inner surface 720 of the at least one retainer slot 702. Alternatively, the at least one tooth slot 718 may be formed in a circumferential side surface of the retainer slot 702. As the sleeve 602 of the shear mechanism 536 moves toward the locked position, an interface between the at least one tooth 714 and the radially inner surface 720 of the retainer slot 702 may deflect the locking feature 618 in a radially outward direction 722. Alternatively, or additionally, the at least one tooth 714 may be flexible to deflect in response to contact with the retainer slot 702. However, in response to the at least one tooth 714 axially aligning with the corresponding tooth slot 718, the locking feature may move radially inward and hold the at least one tooth 714 in the corresponding tooth slot 718. The interface between the at least one tooth 714 and the corresponding tooth slot 718 may restrain axial movement of the sleeve 602 with respect to the retainer sub 204 to hold the shear mechanism 536 in the locked position (e.g., the second axial position).

Moreover, as set forth above, the interface feature 608 has the protrusion 704 extending radially outward from the sleeve 602 as the swivel sub 114 is run-in-hole. However, after the shear member 534 is sheared and the shear mechanism 536 is disposed in the locked position, the protrusion 704 no longer needs to interface with the downhole tool 108. As such, in the locked position, the protrusion 704 may be configured to deflect radially inward towards the spool mandrel 122 in response to further contact with the downhole tool 108 and/or any other restrictions in the wellbore. In particular, the protrusion 704 may extend radially outward from a central portion 724 of the sleeve 602, and the central portion 724 may be radially offset from the spool mandrel 122, such that a gap 726 is formed between an inner surface 728 of the sleeve 602 and the spool mandrel 122. Further, the first end 700 (e.g., the upper end) of the sleeve 602 is radially supported by the interface between the locking feature 618 and the retainer slot 702 of the retainer sub 204, and a second end 732 (e.g., the lower end) of the sleeve 602 is radially supported by the spool mandrel 122. In particular, the second end 732 of the sleeve 602 may be thicker than the central portion 724 of the sleeve 602 such that the central portion 724 is radially offset from the spool mandrel 122 with the second end 732 contacting the spool mandrel 122. Additionally, the leading face 706 of the protrusion 704 may comprise a ramped surface 734 such that axial force on the leading face 706, via the interface with the downhole tool 108, may comprise an axial and radial component. The radial component of the force may cause the central portion 724 of the sleeve 602 to deflect (e.g., bend) radially inwards such that the protrusion 704 is displaced radially inward to move the leading face 706 of the protrusion 704 out of contact with the downhole tool 108.

Figure 8A:
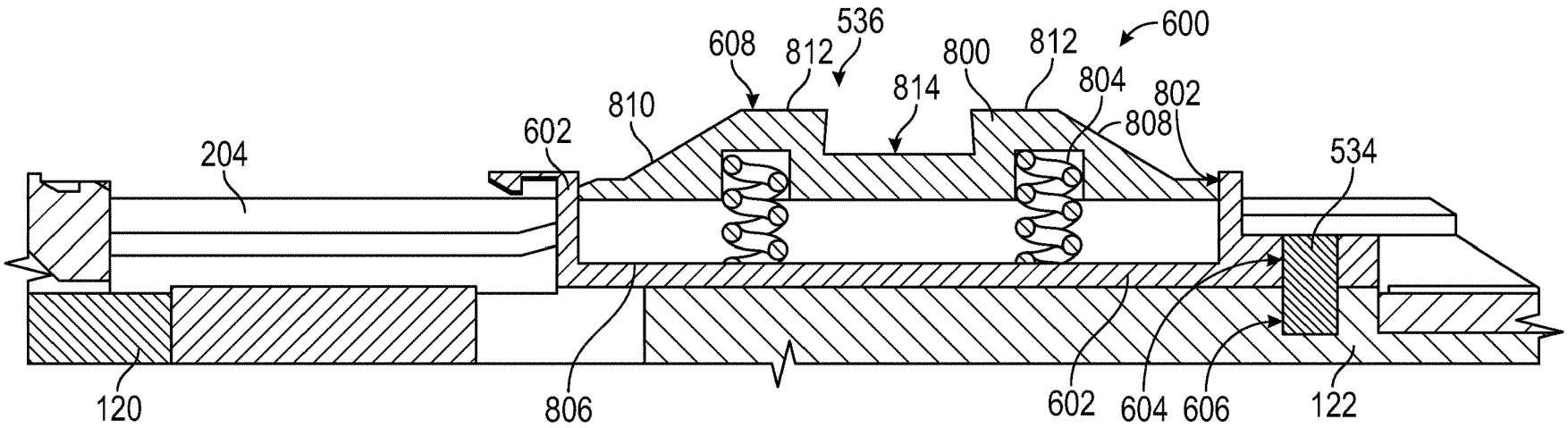
FIGS. 8A-B illustrate respective cross-sectional views of a compression feature shear mechanism, in accordance with some embodiments of the present disclosure.
Figure 8B:
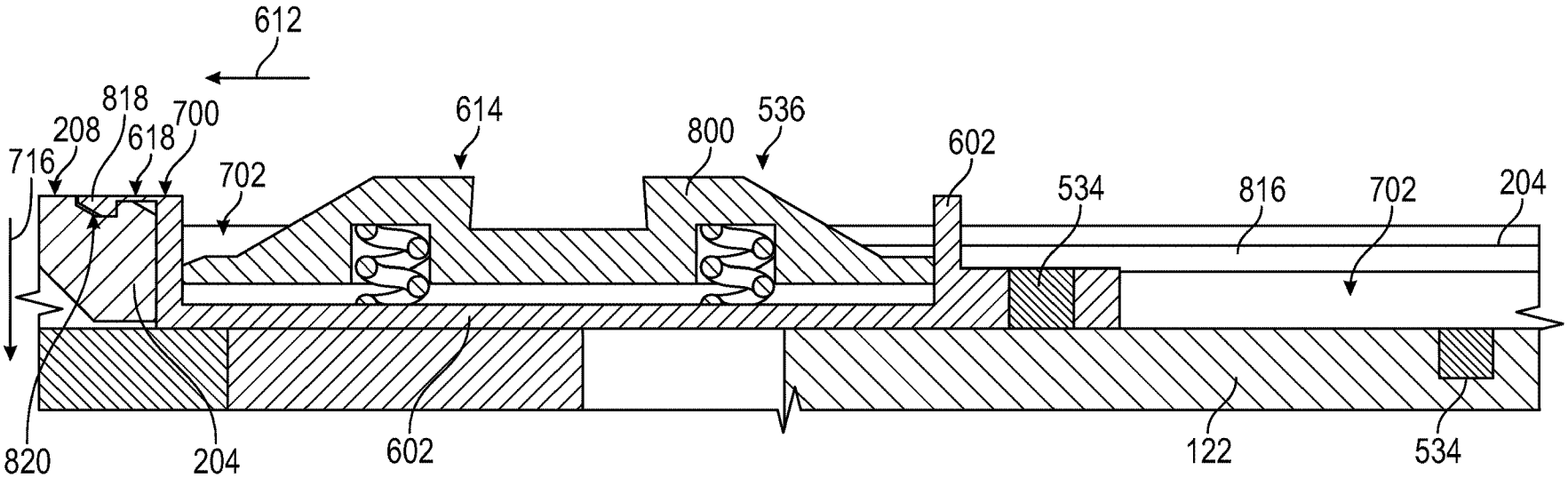

FIGS. 8A-B illustrate respective cross-sectional views of a compression feature shear mechanism, in accordance with some embodiments of the present disclosure. FIG. 8A illustrates a cross-sectional view of the shear mechanism 536 (e.g., a compression feature shear mechanism) and the shear member 534 (e.g., shear pin) holding the spool mandrel 122 in the run-in position (e.g., the first axial position 600). As set forth above, the retainer sub 204 may be rigidly secured to the connector sub 120 such that the retainer sub 204 is axially and rotationally fixed with respect to the connector sub 120. Further, the shear mechanism 536 may be rotationally fixed with respect to the retainer sub 204 in the first axial position 600, as set forth in greater detail below. Moreover, the sleeve 602 of the shear mechanism 536 may have the shear member slot 604. As illustrated, the shear member 534 may be disposed in the shear member slot 604 to hold the spool mandrel 122 in the run-in position as the swivel sub 114 is run-in-hole. That is, the shear member 534 may extend through the shear member slot 604 and into a spool slot 606 formed in the spool mandrel 122. As such, the shear member 534 may restrain rotational movement, as well as axial movement, between the shear mechanism 536 and the spool mandrel 122, which may restrain rotational movement between the spool mandrel 122 and the connector sub 120.

The shear mechanism 536 further includes the interface feature 608 configured to engage (e.g., contact) the downhole tool 108 as the conveyance 118 drives the swivel sub 114 into the downhole tool 108 (shown in FIG. 1). The interface feature 608 may include a compression feature 800 housed by the sleeve 602. In particular, the compression feature 800 may be housed within a sleeve slot 802 of the sleeve 602, such that the compression feature 800 may move radially (e.g., extend and/or retract) with respect to the sleeve 602. Further, at least one sleeve spring 804 may be disposed between a radially inner surface 806 of the sleeve slot 802 and the compression feature 800. The at least one sleeve spring 804 may bias the compression feature toward a position (e.g., an extended position) to engage the downhole tool 108 as the swivel sub 114 is run-in-hole.

As illustrated, the compression feature 800 may include a leading compression feature face 808, a trailing compression feature face 810, a radially outer compression feature face 812, and an interface slot 814 configured to engage the downhole tool 108. As illustrated, the interface slot 814 may be formed in the radially outer compression feature face 812. The interface slot 814 of the compression feature 800 may be configured to engage the downhole tool 108. Contact between the interface slot 814 of the compression feature 800 and the downhole tool 108 may generate a force on the compression feature 800 to drive the compression feature 800 and the sleeve 602 in the axially uphole direction 612 with respect to the spool mandrel 122. However, as set forth above, the shear member 534 may restrain axial movement of the sleeve 602 with respect to the spool mandrel 122. That is, the shear member 534 may restrain axial movement of the sleeve 602 until the force being applied to the sleeve 602 exceeds a threshold force. At or above the threshold force, the sleeve 602 may shear the shear member 534 and slide in the axially uphole direction 612. The swivel sub 114 engaging the downhole tool 108 may apply a force to the sleeve 602, at or above the threshold force, such that the shear mechanism 536 may shear the shear member 534 in response to the swivel sub apparatus 114 engaging a downhole tool 108.

FIG. 8B illustrates a cross-sectional view of the shear mechanism 536 disposed in a locked position 614 (e.g., the second axial position) after sliding in the axially uphole direction 612 in response to the shear member 534 being sheared. In particular, in response to the shear member 534 being sheared, the force on the compression feature 800 from the downhole tool 108 may drive the sleeve 602 to slide along a guide path 816 toward the second axial position. The compression feature 800 may include at least one guide protrusion (not shown) that extends into the guide path 816 (e.g., a channel formed in the retainer slot 702 defined in the retainer sub 204. The interface between the guide path 816 and the at least one guide protrusion may control a radial position of the compression feature 800 as the sleeve 602 and compression feature 800 move along the guide path 816. As illustrated, the guide path 816 may extend along an axial length of the retainer slot 702. Further, the guide path 816 may shift in the radially inward direction 716 (shown in FIG. 8A) such that a portion of the guide path 816 proximate the first axial position 600 is disposed radially outward from a portion of the guide path proximate the second axial position (e.g., the locked position 614). As such, as the sleeve 602 and compression feature 800 move toward the second axial position, the guide path 816 may drive the compression feature 800 radially inward to a retracted position. Moreover, contact between sides of the compression feature 800 and/or the sleeve 602 with sidewalls of the retainer slot 702 may restrain rotational movement of the shear mechanism 536 such that the shear mechanism 536 may be rotationally fixed with respect to the retainer sub 204 in the second axial position and/or the first axial position 600.

Moreover, the shear mechanism 536 may include at least one locking feature 618 extending axially from the first end 700 (e.g., uphole end) of the sleeve 602. The locking feature 618 may comprise at least one locking protrusion 818 extending radially inward from the locking feature 618. Further, the retainer sub 204 may include at least one corresponding locking feature slot 820. The locking feature slot 820 may be formed in a radial outer retainer surface 208 of the retainer sub 204. As the sleeve 602 of the shear mechanism 536 moves toward the locked position, an interface between the locking protrusion 818 and the radial outer retainer surface 208 may deflect the locking feature 618 radially outward. However, in response to the locking protrusion 818 axially aligning with the locking feature slot 820, the locking feature 618 may move radially inward and hold the locking protrusion 818 in the locking feature slot 820. The interface between the locking protrusion 818 and the locking feature slot 820 may restrain axial movement of the sleeve 602 with respect to the retainer sub 204 to hold the shear mechanism 536 in the locked position (e.g., the second axial position).

Figure 9A:
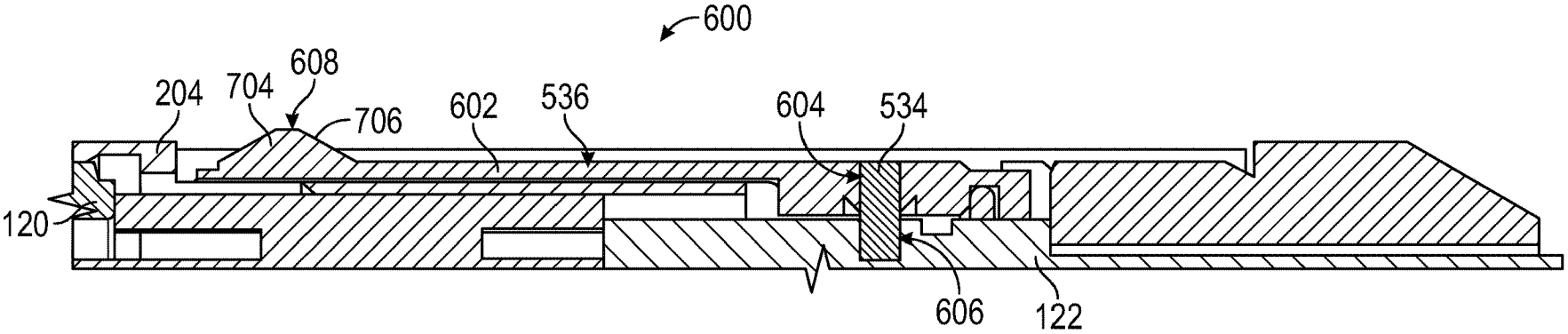
FIGS. 9A-B illustrate respective cross-sectional views of single ended collet shear mechanism, in accordance with some embodiments of the present disclosure.
Figure 9B:
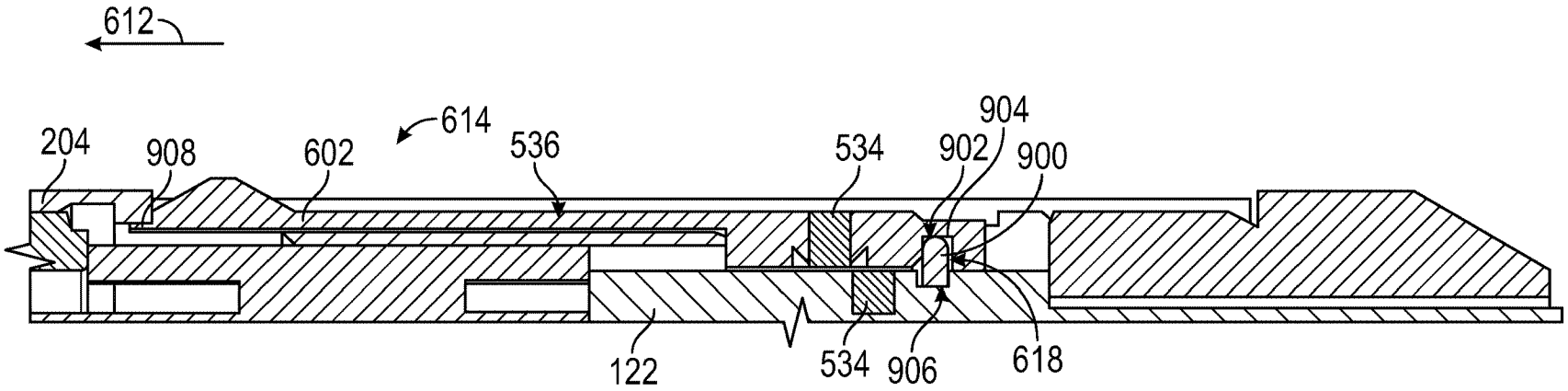

FIGS. 9A-B illustrate respective cross-sectional views of single ended collet shear mechanism, in accordance with some embodiments of the present disclosure. FIG. 9A illustrates a cross-sectional view of the shear mechanism 536 (e.g., a single ended collet shear mechanism) and the shear member 534 (e.g., shear pin) holding the spool mandrel 122 in the run-in position (e.g., the first axial position 600). As set forth above, the retainer sub 204 may be rigidly secured to the connector sub 120 such that the retainer sub 204 is axially and rotationally fixed with respect to the connector sub 120. Further, as set forth above, the shear mechanism 536 may be rotationally fixed with respect to the retainer sub 204 in the first axial position 600. Moreover, the sleeve 602 of the shear mechanism 536 may have the shear member slot 604. As illustrated, the shear member 534 may be disposed in the shear member slot 604 to hold the spool mandrel 122 in the run-in position as the swivel sub 114 is run-in-hole. That is, the shear member 534 may extend through the shear member slot 604 and into a spool slot 606 formed in the spool mandrel 122. As such, the shear member 534 may restrain rotational movement, as well as axial movement, between the shear mechanism 536 and the spool mandrel 122, which may restrain rotational movement between the spool mandrel 122 and the connector sub 120.

The shear mechanism 536 further includes the interface feature 608 configured to engage (e.g., contact) the downhole tool 108 as the conveyance 118 drives the swivel sub 114 into the downhole tool 108 (shown in FIG. 1). The interface feature 608 may include the protrusion 704 extending radially outward from the sleeve 602, such that the interface feature 608 may be positioned to engage the downhole tool 108 as the swivel sub 114 is run-in-hole. The leading face 706 of the protrusion 704 may be configured to engage the downhole tool 108. Contact between the leading face 706 of the protrusion 704 and the downhole tool 108 may generate a force on the protrusion 704 to drive the protrusion 704 and the sleeve 602 in the axially uphole direction 612 with respect to the spool mandrel 122. However, as set forth above, the shear member 534 may restrain axial movement of the sleeve 602 with respect to the spool mandrel 122. That is, the shear member 534 may restrain axial movement of the sleeve 602 until the force being applied to the sleeve 602 exceeds a threshold force. At or above the threshold force, the sleeve 602 may shear the shear member 534 and slide in the axially uphole direction 612. The swivel sub 114 engaging the downhole tool 108 may apply a force to the sleeve 602, at or above the threshold force, such that the shear mechanism 536 may shear the shear member 534 in response to the swivel sub apparatus 114 engaging a downhole tool 108.

FIG. 9B illustrates a cross-sectional view of the shear mechanism 536 disposed in a locked position 614 (e.g., a second axial position) after sliding in the axially uphole direction 612 in response to the shear member 534 being sheared. As set forth above, the shear mechanism 536 may include at least one locking feature 618 configured to hold the shear mechanism 536 in the locked position 614. For example, the locking feature 618 may include a snap ring 900. As illustrated, the shear mechanism 536 may include a shear recess 902 formed in the radially inner surface 904 of the shear mechanism 536. Further, a corresponding spool groove 906 may be formed in the spool mandrel 122. In the first axial position 600, the shear recess 902 may be disposed downhole from the spool groove 906. However, as the shear mechanism 536 slides in the axially uphole direction 612 from the first axial position 600, the shear recess 902 may align with the spool groove 906 such that the locking feature 618 (e.g. the snap ring 900) may expand from the spool groove 906 to the shear recess 902, or contract from the shear recess 902 into the spool groove 906, to restrain axial movement of the shear mechanism 536 with respect to the spool mandrel 122 in the second axial position. That is, the shear recess 902 may be axially aligned with the spool groove 906 in the second axial position. Moreover, the snap ring 900 may restrain axial movement, but may permit rotational movement between the shear mechanism 536 and the spool mandrel 122 such that the spool mandrel 122 may rotate to align the control line 116 with the corresponding connector 128 of the downhole tool 108 (shown in FIG. 1).

Further, the shear mechanism 536 may include at least one finger 908 extending axially uphole from the sleeve 602 of the shear mechanism 536. The finger 908 may be disposed radially inward from a portion of the retainer sub 204 in the second axial position. Radial movement of the shear mechanism 536 may drive the finger 908 into the retainer sub 204. Contact between the finger 908 and the retainer sub 204 may restrain radial movement of the shear mechanism 536 in the locked position 614 such that the shear mechanism 536 does not flare out after moving into the locked position 614.

Figure 10A:
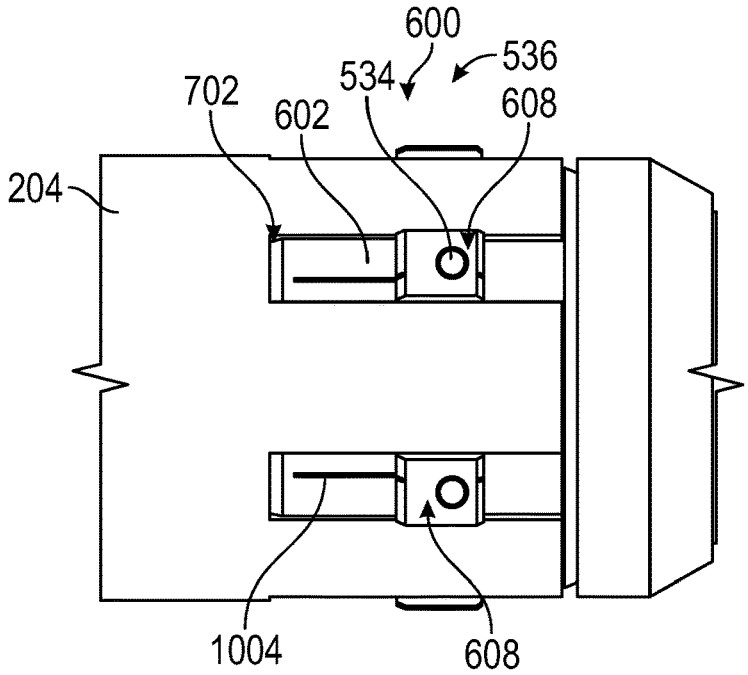
FIGS. 10A-C illustrate respective perspective and cross-sectional views of a collet sleeve shear mechanism, in accordance with some embodiments of the present disclosure.
Figure 10B:
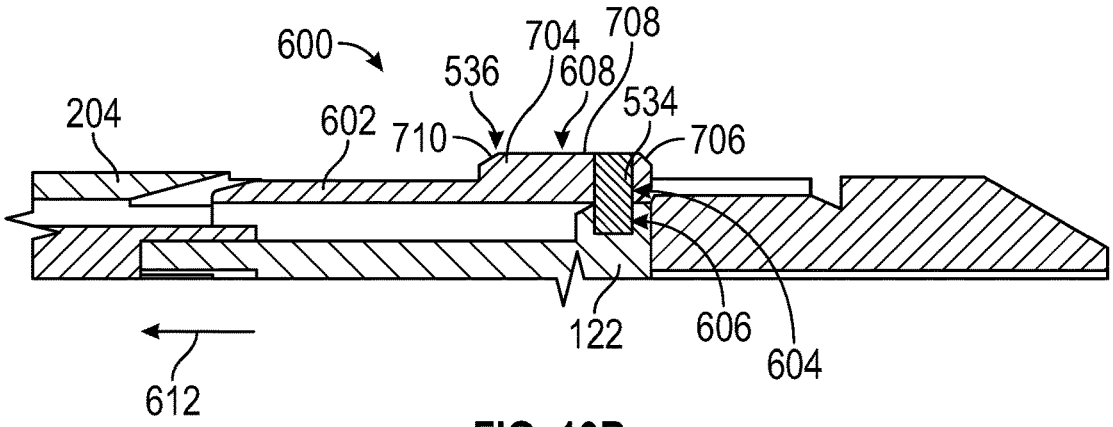
Figure 10C:
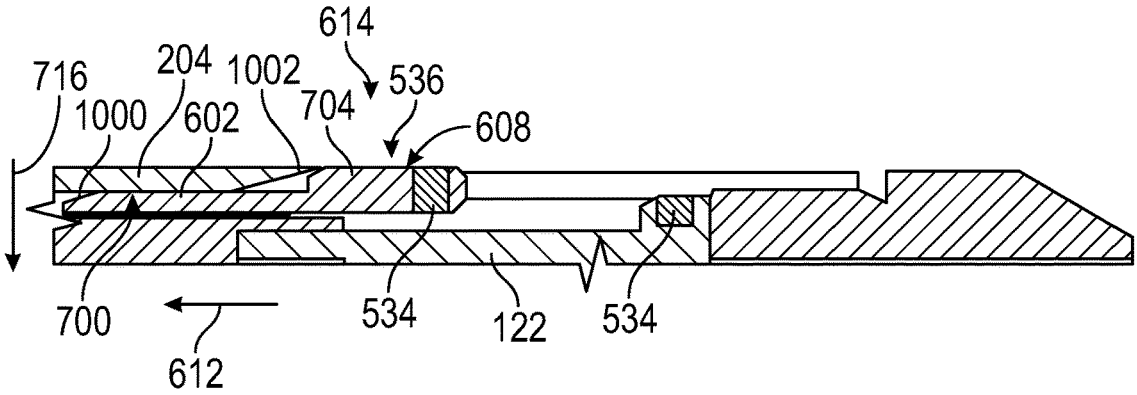

FIGS. 10A-C illustrate respective cross-sectional views of a collet sleeve shear mechanism, in accordance with some embodiments of the present disclosure. In particular, FIG. 10A illustrates a perspective view of the shear mechanism 536 (e.g., a collet sleeve shear mechanism) and the shear member 534 (e.g., shear pin) holding the spool mandrel 122 in a run-in position (e.g., a first axial position 600). The shear mechanism 536 may include the sleeve 602 extending circumferentially about the spool mandrel 122, and the at least one interface feature 608 extending radially outward from the sleeve 602. As illustrated, the at least one interface feature 608 may include a plurality of interface features 608 disposed about the sleeve 602. Further, in the run-in-position (e.g., the first axial position 600), each interface feature 608 may be disposed in a corresponding retainer slot 702 in the retainer sub 204. Circumferential contact between the interface features 608 and sidewalls of the retainer slot 702 may restrain rotational movement of the shear mechanism 536 with respect to the retainer sub 204 in at least the first axial position 600. Moreover, the interface features 608 may be evenly spaced about the circumference of the sleeve 602. For example, the interface features 608 may be spaced thirty degrees to 90 degrees apart. Alternatively, the interface features 608 may be unevenly spaced about the circumference of the sleeve 602.

FIG. 10B illustrates a cross-sectional view of the shear mechanism 536 and the shear member 534 (e.g., shear pin) holding the spool mandrel 122 in the run-in position (e.g., the first axial position 600). As set forth above, the retainer sub 204 may be rigidly secured to the connector sub 120 such that the retainer sub 204 is axially and rotationally fixed with respect to the connector sub 120. Further, as set forth above, the shear mechanism 536 may be rotationally fixed with respect to the retainer sub 204 in the first axial position 600. Moreover, the sleeve 602 of the shear mechanism 536 may have the shear member slot 604. As illustrated, the shear member 534 may be disposed in the shear member slot 604 to hold the spool mandrel 122 in the run-in position as the swivel sub 114 is run-in-hole. That is, the shear member 534 may extend through the shear member slot 604 and into a spool slot 606 formed in the spool mandrel 122. As such, the shear member 534 may restrain rotational movement, as well as axial movement, between the shear mechanism 536 and the spool mandrel 122, which may restrain rotational movement between the spool mandrel 122 and the connector sub 120.

The shear mechanism 536 further includes the interface feature 608 configured to engage (e.g., contact) the downhole tool 108 as the conveyance 118 drives the swivel sub 114 into the downhole tool 108 (shown in FIG. 1). The interface feature 608 may include a protrusion 704 extending radially outward from the sleeve 602, such that the interface feature 608 may be positioned to engage the downhole tool 108 as the swivel sub 114 is run-in-hole. The leading face 706 of the protrusion 704 may be configured to engage the downhole tool 108. The protrusion 704 may also include the radially outer face 708 and the trailing face 710. The shear member slot 604 may extend through the radially outer face 708. Moreover, contact between the leading face 706 of the protrusion 704 and the downhole tool 108 may generate a force on the protrusion 704 to drive the protrusion 704 and the sleeve 602 in the axially uphole direction 612 with respect to the spool mandrel 122. However, as set forth above, the shear member 534 may restrain axial movement of the sleeve 602 with respect to the spool mandrel 122. That is, the shear member 534 may restrain axial movement of the sleeve 602 until the force being applied to the sleeve 602 exceeds a threshold force. At or above the threshold force, the sleeve 602 may shear the shear member 534 and slide in the axially uphole direction 612. The swivel sub 114 engaging the downhole tool 108 may apply a force to the sleeve 602, at or above the threshold force, such that the shear mechanism 536 may shear the shear member 534 in response to the swivel sub apparatus 114 engaging a downhole tool 108.

FIG. 10C illustrates a cross-sectional view of the shear mechanism 536 disposed in a locked position 614 (e.g., a second axial position) after sliding in the axially uphole direction 612 in response to the shear member 534 being sheared. With the shear mechanism 536 in the locked position 614 and the shear member 534 sheared, the spool mandrel 122 may rotate freely with respect to the retainer sub 204 and connector sub 120 to align the mating end 124 of the control line 116 with the corresponding connector 128 of the downhole tool 108 (shown in FIG. 1).

Moreover, as set forth above, the protrusion 704 interface feature 608 extends radially outward from the sleeve 602 in the first axial position 600. However, after the shear member 534 is sheared and the shear mechanism 536 is disposed in the locked position, the protrusion 704 no longer needs to interface with the downhole tool 108. As such, as the sleeve 602 moves toward the locked position 614 in response to further contact with the downhole tool 108 and/or any other restrictions in the wellbore 104, the sleeve 602 (e.g., collet) may deflect in the radially inward direction 716 toward the spool mandrel 122 to reposition the protrusion 704 to a retracted position. In particular, the first end 700 (e.g., the uphole end) of the sleeve 602 may include a ramped sleeve surface 1000. Further, the retainer sub 204 may include a corresponding ramped retainer surface 1002. The interface between the ramped sleeve surface 1000 and the ramped retainer surface 1002 may guide the sleeve 602 to compress radially inward as the sleeve 602 moves in the axially uphole direction 612. The sleeve 602 (e.g., collet) may include axially extending slots 1004 (shown in FIG. 10A) about the circumference of the sleeve 602 such that the sleeve 602 may compress radially inward. Moreover, in the locked position 614, at least a portion of the sleeve 602 may be disposed between the retainer sub 204 and the spool mandrel 122, and the protrusion 704 may be retracted (e.g., positioned radially inward with respect to the run-in-position).

Accordingly, the present disclosure may provide a swivel sub having a spool mandrel configured to rotate with respect to a connector sub, between a first angular position and a second to align a mating end of a control line with a corresponding connector of a downhole tool. The swivel sub having a biasing member to restrain rotation between the first angular position and the second angular position to avoid straining and damaging the control line. The systems may include any of the various features disclosed herein, including one or more of the following statements.

Statement 1. An apparatus, comprising: a connector sub rigidly securable to a conveyance for running the connector sub along a wellbore; a spool mandrel coupled to a downhole end of the connector sub, wherein the spool mandrel is rotatable with respect to the connector sub; and a control line extending between the connector sub and the spool mandrel, and wherein the control line is displaceable to permit rotation of the spool mandrel with respect to the connector sub; and at least one biasing member for biasing the spool mandrel to a neutral position with respect to the connector sub.

Statement 2. The apparatus of claim 1, wherein a portion of the control line is coiled around the spool mandrel, and wherein the at least one biasing member comprises a coiled portion of the control line.

Statement 3. The apparatus of any preceding statement, wherein the control line uncoils and/or stretches in response to rotation of the spool mandrel in a first direction, which places the coiled portion of the control line in tension, and wherein the control line recoils and/or contracts in response to rotation of the spool mandrel in a second direction, which places the coiled portion of the control line in compression.

Statement 4. The apparatus of any preceding statement, wherein the control line comprises an outer jacket, wherein the outer jacket elastically strains in response to tension and/or compression on the control line, and wherein the elastic strain on the outer jacket generates a biasing force to return the coiled portion of the control line to a neutral state, which drives rotation of the spool mandrel to the neutral position of the spool mandrel with respect to the connector sub.

Statement 5. The apparatus of any preceding statement, wherein the at least one biasing member comprises a return spring secured to the connector sub and the spool mandrel, wherein rotation of the spool mandrel with respect to the connector sub elastically strains the return spring, which generates a biasing force to drive rotation of the mandrel to the neutral position of the spool mandrel with respect to the connector sub.

Statement 6. The apparatus of any preceding statement, wherein the at least one biasing member comprises a coiled portion of the control line and a return spring.

Statement 7. The apparatus of any preceding statement, further comprising at least one control line housing for anchoring the control line to the apparatus, wherein the control line housing restrains axial movement of the control line with respect to the apparatus.

Statement 8. The apparatus of any preceding statement, wherein a control line housing is secured to the connector sub in a position uphole from a coiled portion of the control line, and wherein an additional control line housing is secured to a clamped mandrel and/or lower connector mandrel in a position downhole from the coiled portion of the control line.

Statement 9. The apparatus of any preceding statement, further comprising a shroud disposed about the spool mandrel, wherein a coiled portion of the control line is disposed radially between the shroud and the spool mandrel, and wherein the shroud protects the coiled portion of the control line from downhole conditions.

Statement 10. The apparatus of any preceding statement, wherein the control line is couplable with a corresponding conveyance control line extending along the conveyance to put the control line in communication with the surface.

Statement 11. The apparatus of any preceding statement, wherein the control line is couplable with a downhole tool disposed in the wellbore to provide communication from the surface to the downhole tool.

Statement 12. The apparatus of any preceding statement, further comprising a shear member and a shear mechanism, wherein the shear mechanism comprises a sleeve having a shear member slot and an interface feature configured to engage a downhole tool, wherein the shear member is disposed in the shear member slot to restrain rotational movement of the spool mandrel with respect to the connector sub in a run-in position, and wherein the sleeve is configured to slide axially to shear the shear pin in response to the interface feature engaging the downhole tool.

Statement 13. The apparatus of any preceding statement, wherein the interface feature comprises a protrusion extending radially outward from the sleeve, wherein the sleeve is configured to slide axially to shear the shear member in response to the protrusion engaging the downhole tool.

Statement 14. The apparatus of any preceding statement, further comprising a retainer sub rigidly coupled to the connector sub, wherein the shear mechanism is fixed to the spool mandrel via the shear member as the apparatus in the run-in position, and wherein an interface between the shear mechanism and the retainer sub restrains rotational movement between the shear mechanism and the retainer sub in the run-in position.

Statement 15. An apparatus, comprising: a connector sub rigidly securable to a conveyance for running the connector sub along a wellbore; a spool mandrel coupled to a downhole end of the connector sub, wherein the spool mandrel is rotatable with respect to the connector sub; a control line extending between the connector sub and the spool mandrel, and wherein the control line is displaceable to permit rotation of the spool mandrel with respect to the connector sub; and a return spring secured to the connector sub and the spool mandrel, wherein rotation of the spool mandrel with respect to the connector sub elastically strains the return spring, which generates a biasing force to drive rotation of the mandrel to a neutral angular position of the spool mandrel with respect to the connector sub.

Statement 16. The apparatus of statement 15, wherein a first end of the return spring is secured to the connector sub and a second end of the return spring is secured to the spool mandrel.

Statement 17. The apparatus of statement 15 or statement 16, wherein the return spring is disposed between the connector sub and the spool mandrel.

Statement 18. The apparatus of any of statements 15-17, wherein the return spring comprises a compression spring, a tension spring, a torsion spring, or some combination thereof.

Statement 19. An apparatus, comprising: a connector sub rigidly securable to a conveyance for running the connector sub along a wellbore; a spool mandrel coupled to a downhole end of the connector sub, wherein the spool mandrel is rotatable with respect to the connector sub; a control line extending between the connector sub and the spool mandrel, and wherein the control line is displaceable to permit rotation of the spool mandrel with respect to the connector sub; a return spring secured to the connector sub and the spool mandrel, wherein rotation of the spool mandrel with respect to the connector sub elastically strains the return spring, which generates a biasing force to drive rotation of the mandrel to a neutral angular position of the spool mandrel with respect to the connector sub; a retainer sub disposed radially exterior to the connector sub and the spool mandrel, wherein the retainer sub restrains axial movement of the spool mandrel with respect to the connector sub; a shear member for restraining rotational movement of the spool mandrel with respect to the connector sub as the apparatus is run-in-hole; and a shear mechanism for shearing the shear member in response to the apparatus engaging a downhole tool.

Statement 20. The apparatus of statement 19, wherein the shear mechanism comprises an interface surface, wherein the shear mechanism is actuatable in response to the interface surface contacting a corresponding surface of the downhole tool.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. An apparatus, comprising:

a connector sub rigidly securable to a conveyance for running the connector sub along a wellbore;

a spool mandrel coupled to a downhole end of the connector sub, wherein the spool mandrel is rotatable with respect to the connector sub;

a control line extending between the connector sub and the spool mandrel, and wherein the control line is displaceable to permit rotation of the spool mandrel with respect to the connector sub; and at least one biasing member for biasing the spool mandrel to a neutral position with respect to the connector sub, wherein a portion of the control line is coiled around the spool mandrel, and wherein the at least one biasing member comprises a coiled portion of the control line, wherein at least a portion of the control line includes an elastic material configured to elastically strain in response to tension and/or compression on the control line, wherein the elastic strain generates a biasing force to return the coiled portion of the control line to a neutral state, which drives rotation of the spool mandrel to the neutral position of the spool mandrel with respect to the connector sub.

2. The apparatus of claim 1, wherein the control line uncoils and/or stretches in response to rotation of the spool mandrel in a first direction, which places the coiled portion of the control line in tension, and wherein the control line recoils and/or contracts in response to rotation of the spool mandrel in a second direction, which places the coiled portion of the control line in compression.

3. The apparatus of claim 1, wherein the control line comprises an outer jacket, wherein the outer jacket elastically strains in response to tension and/or compression on the control line, and wherein the elastic strain on the outer jacket generates the biasing force to return the coiled portion of the control line to a neutral state, which drives rotation of the spool mandrel to the neutral position of the spool mandrel with respect to the connector sub.

4. The apparatus of claim 1, further comprising at least one control line housing for anchoring the control line to the apparatus, wherein the control line housing restrains axial movement of the control line with respect to the apparatus.

5. The apparatus of claim 1, wherein a control line housing is secured to the connector sub in a position uphole from a coiled portion of the control line, and wherein an additional control line housing is secured to a clamped mandrel and/or lower connector mandrel in a position downhole from the coiled portion of the control line.

6. The apparatus of claim 1, further comprising a shroud disposed about the spool mandrel, wherein a coiled portion of the control line is disposed radially between the shroud and the spool mandrel, and wherein the shroud protects the coiled portion of the control line from downhole conditions.

7. The apparatus of claim 1, wherein the control line is couplable with a corresponding conveyance control line extending along the conveyance to put the control line in communication with the surface.

8. The apparatus of claim 1, wherein the control line is couplable with a downhole tool disposed in the wellbore to provide communication from the surface to the downhole tool.

9. The apparatus of claim 1, further comprising a shear member and a shear mechanism, wherein the shear mechanism comprises a sleeve having a shear member slot and an interface feature configured to engage a downhole tool, wherein the shear member is disposed in the shear member slot to restrain rotational movement of the spool mandrel with respect to the connector sub in a run-in position, and wherein the sleeve is configured to slide axially to shear the shear pin in response to the interface feature engaging the downhole tool.

10. The apparatus of claim 9, wherein the interface feature comprises a protrusion extending radially outward from the sleeve, wherein the sleeve is configured to slide axially to shear the shear member in response to the protrusion engaging the downhole tool.

11. The apparatus of claim 9, further comprising a retainer sub rigidly coupled to the connector sub, wherein the shear mechanism is fixed to the spool mandrel via the shear member as the apparatus in the run-in position, and wherein an interface between the shear mechanism and the retainer sub restrains rotational movement between the shear mechanism and the retainer sub in the run-in position.

12. An apparatus, comprising:

a connector sub rigidly securable to a conveyance for running connector sub along a wellbore;

a spool mandrel coupled to a downhole end of the connector sub, wherein the spool mandrel is rotatable with respect to the connector sub; and a control line extending between the connector sub and the spool mandrel, and wherein the control line is displaceable to permit rotation of the spool mandrel with respect to the connector sub; and at least one biasing member for biasing the spool mandrel to a neutral position with respect to the connector sub, wherein the at least one biasing member comprises a return spring secured to the connector sub and the spool mandrel, wherein rotation of the spool mandrel with respect to the connector sub elastically strains the return spring, which generates a biasing force to drive rotation of the mandrel to the neutral position of the spool mandrel with respect to the connector sub.

13. An apparatus, comprising:

a connector sub rigidly securable o a conveyance for running the connector sub along a wellbore;

a spool mandrel coupled to a downhole end of the connector sub, wherein the spool mandrel is rotatable with respect to the connector sub, and a control line extending between the connector sub and the spool mandrel, and wherein the control line is displaceable to permit rotation of the spool mandrel with respect to the connector sub; and at least one biasing member for biasing the spool mandrel to a neutral position with respect to the connector sub, wherein the at least one biasing member comprises a coiled portion of the control line and a return spring.

14. An apparatus, comprising:

a connector sub rigidly securable to a conveyance for running the connector sub along a wellbore;

a spool mandrel coupled to a downhole end of the connector sub, wherein the spool mandrel is rotatable with respect to the connector sub;

a control line extending between the connector sub and the spool mandrel, and wherein the control line is displaceable to permit rotation of the spool mandrel with respect to the connector sub; and at least one biasing member for biasing the spool mandrel to a neutral position with respect to the connector sub;

a shear member and a shear mechanism, wherein th e shear mechanism comprises a sleeve having a shear member slot and an interface feature configured to engage a downhole tool, wherein the shear member is disposed in the shear member slot to restrain rotational movement of the spool mandrel with respect to the connector sub in a run-in position, and wherein the sleeve is configured to slide axially to shear the shear pin in response to the interface feature engaging the downhole tool.

15. The apparatus of claim 14, wherein the at least one biasing member includes a return spring secured to the connector sub and the spool mandrel wherein rotation of the spool mandrel with respect to the connector sub elastically strains the return spring, which generates a biasing force to drive rotation of the mandrel to a neutral angular position of the spool mandrel with respect to the connector sub.

16. The apparatus of claim 15, wherein the return spring is disposed between the connector sub and the spool mandrel.

17. The apparatus of claim 15, wherein the return spring comprises a compression spring, a tension spring, a torsion spring, or some combination thereof.

18. The apparatus of claim 15, wherein a first end of the return spring is secured to the connector sub and a second end of the return spring is secured to the spool mandrel.

19. An apparatus, comprising:

a connector sub rigidly securable to a conveyance for running the connector sub along a wellbore;

a spool mandrel coupled to a downhole end of the connector sub, wherein the spool mandrel is rotatable with respect to the connector sub;

a control line extending between the connector sub and the spool mandrel, and wherein the control line is displaceable to permit rotation of the spool mandrel with respect to the connector sub;

a return spring secured to the connector sub and the spool mandrel, wherein rotation of the spool mandrel with respect to the connector sub elastically strains the return spring, which generates a biasing force to drive rotation of the mandrel to a neutral angular position of the spool mandrel with respect to the connector sub;

a retainer sub disposed radially exterior to the connector sub and the spool mandrel, wherein the retainer sub restrains axial movement of the spool mandrel with respect to the connector sub;

a shear member for restraining rotational movement of the spool mandrel with respect to the connector sub as the apparatus is run-in-hole; and a shear mechanism for shearing the shear member in response to the apparatus engaging a downhole tool.

20. The apparatus of claim 19, wherein the shear mechanism comprises an interface surface, wherein the shear mechanism is actuatable in response to the interface surface contacting a corresponding surface of the downhole tool.

* * * * *